US006187517B1

(12) United States Patent
Whitesides et al.

(10) Patent No.: US 6,187,517 B1
(45) Date of Patent: Feb. 13, 2001

(54) ENZYME-ACTIVATED WATER-RESISTANT PROTECTIVE OVERCOAT FOR A PHOTOGRAPHIC ELEMENT

(75) Inventors: Thomas H. Whitesides; Hwei-Ling Yau; Amy Jasek, all of Rochester, NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/591,430

(22) Filed: Jun. 9, 2000

(51) Int. Cl.[7] ..... G03C 5/16

(52) U.S. Cl. ..... 430/350; 430/432; 430/448; 430/463; 430/537; 430/539; 430/935; 430/961

(58) Field of Search ..... 430/537, 539, 430/350, 432, 463, 448, 493, 961, 935

(56) References Cited

U.S. PATENT DOCUMENTS

| | | | |
|---|---|---|---|
| 2,173,480 | 9/1939 | Jung . | |
| 2,259,009 | 10/1941 | Talbot . | |
| 2,331,746 | 10/1943 | Talbot . | |
| 2,706,686 | 4/1955 | Hilborn . | |
| 2,798,004 | 7/1957 | Weigel . | |
| 3,113,867 | 12/1963 | Van Norman et al. . | |
| 3,190,197 | 6/1965 | Pinder . | |
| 3,397,980 | 8/1968 | Stone . | |
| 3,415,670 | 12/1968 | McDonald . | |
| 3,697,277 | 10/1972 | King . | |
| 3,733,293 | 5/1973 | Gallagher et al. . | |
| 4,092,173 | 5/1978 | Novak et al. . | |
| 4,171,979 | 10/1979 | Novak et al. . | |
| 4,333,998 | 6/1982 | Lesyk | 430/12 |
| 4,426,431 | 1/1984 | Harasta et al. | 430/14 |
| 4,999,266 | 3/1991 | Platzer et al. | 430/14 |
| 5,376,434 | 12/1994 | Ogawa et al. | 430/627 |
| 5,853,926 | 12/1998 | Bohan et al. | 430/350 |
| 5,856,051 | 1/1999 | Yau et al. | 430/537 |
| 5,910,391 * | 6/1999 | Kondo et al. | 430/248 |

* cited by examiner

*Primary Examiner*—Richard L. Schilling
(74) *Attorney, Agent, or Firm*—Chris P. Konkol

(57) ABSTRACT

The present invention provides a gelatin-based aqueous-coatable overcoat for a photographic element that allows for appropriate diffusion of photographic processing solutions. The overcoat comprises 10 to 50% by weight gelatin and 50 to 90% by weight of hydrophobic particles (by weight of dry laydown of the entire overcoat) having an average diameter of 10 to 500 nm. A proteolytic enzyme is applied to the element in reactive association with the overcoat layer. A photographic element according to one embodiment of the invention can be exposed and processed using normal photofinishing equipment, with no modifications, to provide an imaged element together with a protective, water-resistant layer.

28 Claims, No Drawings

ENZYME-ACTIVATED WATER-RESISTANT PROTECTIVE OVERCOAT FOR A PHOTOGRAPHIC ELEMENT

FIELD OF THE INVENTION

The present invention relates to photographic elements having a protective overcoat that resists fingerprints, common stains, and spills. More particularly, the present invention provides photographic elements comprising a processing-solution-permeable layer that forms a water-resistant protective overcoat in the processed product. The overcoat, before formation of the image, comprises hydrophobic polymeric particles in a gelatin matrix, within or over which overcoat has been introduced, during manufacture, a protcolytic enzyme that hydrolyses the gelatin of the matrix during processing. Upon drying of the photographic element after processing and substantial removal of the gelatin matrix, coalescence of the hydrophobic particles forms a water-resistant continuous protective overcoat.

BACKGROUND OF THE INVENTION

Gelatin has been used extensively in a variety of imaging elements as the binder because of its many unique and advantageous properties. For example, its property of water swellability allows processing chemistry to be carried out to form silver halide-based photographic images. However, due to this same property, imaging elements with exposed golatin-containing materials, no matter if they are formed on transparent or reflective media, have to be handled with care so as not to be in contact with any aqueous solutions that may damage the images. For example, accidental spillage of common household solutions such as coffee, punch, or even plain water can permanently damage photographic prints.

There have been attempts over the years to provide protective layers for gelatin-based photographic systems that will protect the images from damage by water or aqueous solutions. U.S. Pat. No. 2,173,480 describes a method of applying a colloidal suspension to moist film as the last step of photographic processing before drying. A number of patents describe methods of solvent-coating a protective layer on the image after photographic processing is completed and are described, for example, in U.S. Pat. Nos. 2,259,009, 2,331,746, 2,798,004, 3,113,867, 3,190, 197, 3,415,670 and 3,733,293. More recently, U.S. Pat. No. 5,376,434 describes a protective layer formed on a photographic print by coating and drying a latex on a gelatin-containing layer bearing an image. The latex comprises a resin having a glass transition temperature of from 30° C. to 70° C. Another type of protective coating involves the application of UV-polymerizable monomers and oligomers on a processed image followed by radiation exposure to form crosslinked protective layer, which is described in U.S. Pat. Nos. 4,092,173, 4,171,979, 4,333,998 and 4,426,431. A drawback for both the solvent coating method and for the radiation cure method is the health and environmental concern of those chemicals or radiation to the coating operator. Another drawback is that the photographic materials need to be coated after the processing step. Thus, the processing equipment needs to be modified and the personnel running the processing operation need to be trained to apply the protective coating.

Various lamination techniques are known and practiced in the trade. U.S. Pat. Nos. 3,397,980, 3,697,277 and 4,999,266 describe methods of laminating a polymeric sheet film, as a protective layer, on a processed image. However, protective coatings that need to be applied to the image after it is formed, several of which were mentioned above, add a significant cost to the final imaged product. A number of patents have been directed to water-resistant protective coatings that can be applied to a photographic element prior to development. For example, U.S. Pat. No. 2,706.686 describes the formation of a lacquer finish for photographic emulsions, with the aim of providing water- and fingerprint-resistance by coating the light-sensitive layer, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described is coated as a suspension in an organic solvent, and thus is not desirable for large-scale application. More recently, U.S. Pat. No. 5,853,926 to Bohan et al. discloses a protective coating for a photographic element, involving the application of an aqueous coating comprising polymer particles and a soft polymer latex binder. This coating allows for appropriate diffusion of photographic processing solutions, and does not require a coating operation after exposure and processing. Again, however, the hydrophobic polymer particles must be fused to form a protective coating that is continuous and water-impermeable.

The ability to provide the desired property of post-process water/stain resistance of an imaged photographic element, at the point of manufacture of the photographic element, and in a way that involves minimal or no changes in the photofinishing operation, is a highly desired feature. However, in order to accomplish this feature, the desired photographic element must be very permeable to aqueous solutions during the processing step, but become relatively water impermeable or water resistant after the processing is completed. Commonly assigned U.S. Ser. No. 09/235,436 discloses the use of a processing solution permeable overcoat that is composed of a urethane-vinyl copolymer having acid functionalities. Commonly assigned U.S. Ser. No. 09/235,437 and U.S. Ser. No. 09/448,213 disclose the use of a second polymer such as a soluble gelatin or polyvinyl alcohol to improve permeability.

U.S. Pat. No. 5,856,051 describes the use of hydrophobic particles with gelatin as the binder in an overcoat formulation. This invention demonstrated an aqueous coatable, water-resistant protective overcoat that can be incorporated into the photographic product, allows for appropriate diffusion of photographic processing solutions, and does not require a coating operation after exposure and processing. The hydrophobic polymers exemplified in U.S. Pat. No. 5,856,051 include polyethylene having a melting temperature (Tm) of 55 to 200° C., and therefore capable of forming a water-resistant layer by fusing the layer at a temperature higher than the Tm of the polymer after the sample has been processed to generate the image. The coating solution is aqueous and can be incorporated in the manufacturing coating operation without any equipment modification. The fusing step is simple and environmentally friendly to photofinishing laboratories. Since the particles are incorporated entirely within the uppermost layer, this approach does not suffer from a lack of mechanical strength and integrity during transport and handling prior to image formation and fusing. However, the scratch resistance of such an overcoat after fusing is a concern, since polyethylene is a very soft material. More durable materials cannot be used in this application because the crosslinked gelatin in the layer interferes with the film-formation process.

Similarly, commonly assigned U.S. Ser. No. 09/353,939 and U.S. Ser. No. 09/548,514, respectively, describe the use of a polystyrene-based material and a polyurethane-based material, with gelatin as the binder, in an overcoat for a photographic element, which overcoat can be fused into a water resistant overcoat after photographic processing is accomplished to generate an image. Like the polyethylene overcoats described above, the protective properties of this overcoat are compromised by the necessity to form a continuous film in the presence of gelatin in the layer. Only relatively low molecular weight polymers can be used, which afford protective overcoats with inferior properties. Further, the photofinishing operation must include a fusing step in order to achieve a protective layer.

U.S. Ser. No. 09/547,374 (Docket 80610) describes the use of a proteolytic enzyme incorporated into one of the processing solutions that removes gelatin from a nascent protective layer, which layer becomes water resistant upon drying. This method of providing a protective layer still requires modification of the photofinishing process, and is thus inconvenient for the photofinisher to implement.

Therefore, there remains a need for an overcoat applied to a photographic element before development that would not significantly reduce the rate of reaction of the developer with the underlying emulsions, that requires no substantial modification of the commercial photofinishing solutions, and minimal or no other modifications of the photofinishing operation, but that would ultimately provide a water resistant and durable overcoat after the processing or developing step. Furthermore, it would be desirable if the manufacture of the photographic element with the overcoat required no substantial modification of the manufacturing operation.

SUMMARY OF THE INVENTION

The present invention provides a gelatin-based aqueous-coatable protective overcoat for a photographic element that allows for appropriate diffusion of photographic processing solutions. The overcoat is applied to the imaging clement as a composition comprising 10 to 50% by weight gelatin and 50 to 90% by weight of hydrophobic particles (by weight of dry laydown of the entire overcoat) having an average diameter of 10 to 500 nm. Since gelatin comprises a substantial portion of the overcoat layer, photographic elements containing this overcoat are readily manufactured using conventional photographic coating equipment. A proteolytic enzyme is applied to the element in reactive association with the overcoat layer as described below. The layer containing the overcoat polymer and the enzyme can be applied either in the same coating operation (using a slide hopper or other means of applying multiple layers) at the same time with the imaging layer, in a sequential coating operation (using a separate coating station) with the imaging layer, or in a separate coating operation (at a later time to an element having at least one previously applied, dried, and hardened imaging layer), to produce a photographic element comprising a gelatin-containing overcoat. Typically, the gelatin in the overcoat layer is partially hydrolyzed or degraded (digested) by the enzyme. Advantageously, a photographic element according to one embodiment of the invention can be exposed and processed using normal photofinishing equipment, with no modifications, to provide an imaged element that posesses a protective, water-resistant layer. Fusing this layer can sometimes improve the protective properties of the overcoat in the element. According to a preferred embodiment of the invention, however, fusing is not generally required to achieve good protective characteristics. Any polymeric material that is capable of forming a protective layer and that can be coated from a gelatin solution can be used in this invention. By the term "fusing" herein is meant the combination of pressure and heat wherein the heat is applied at a temperature of from 35° C. to 175° C., typically with a pressure roller or belt.

The use of gelatin in the present overcoat provides manufacturing coatability and allows photographic processing. The hydrophobic material for the overcoat can be introduced to the coating melt in a latex form or as a conventional colloidal dispersion in gelatin. In one embodiment the hydrophobic material is in the form of particles having a particle size preferably from 10 nm to 500 nm, more preferably from 30 nm to 250 nm.

Thus, the present invention provides a photographic element comprising at least one imaging layer, over which is applied a gelatin-containing nascent protective overcoat layer in reactive association with a proteolytic enzyme for activating the protective properties of the layer so that the processed photographic element contains a water-resistant, protective layer when processed in conventional photoprocessing solutions and machinery.

DETAILED DESCRIPTION OF THE INVENTION

As mentioned above, the present invention provides a novel photographic element containing a protective overcoat activated by proteolytic enzymolysis during manufacture. An example of a photographic element for which this invention would be particularly useful is a photographic print, which can encounter substantial abuse during normal handling by the end-users. The overcoat formulation of this invention comprises 50% to 90% by weight (based on the dry laydown of the overcoat) of hydrophobic polymer particles of 10 nm to 500 nm in average size and 10% to 50% by weight (based on the dry laydown of the overcoat) of gelatin as binder. Other common addenda, such as hardeners (crosslinkers for the gelatin), speed control dyes, matte particles, spreading agents, charge control agents, dry scratch resistance compounds, and lubricants can also be included in the formulation as needed or appropriate.

The colloidal dispersions of hydrophobic polymers used in this invention are generally latexes or hydrophobic polymers of any composition that can be stabilized as a suspension in a water-based medium. Such hydrophobic polymers are generally classified as either condensation polymers or addition polymers. Condensation polymers include, for example, polyesters, polyamides, polyurethanes, polyureas, polyethers, polycarbonates, polyacid anhydrides, and polymers comprising combinations of the above-mentioned types. Addition polymers are polymers formed from polymerization of vinyl-type monomers including, for example, allyl compounds, vinyl ethers, vinyl heterocylic compounds, styrenes, olefins and halogenated olefins, unsaturated acids and esters derived from them, unsaturated nitrites, vinyl alcohols and ethers or esters thereof, acrylamides , meth-acrylamides or other unsaturated amides, vinyl ketones, multifunctional monomers, or copolymers formed from various combinations of these monomers. Such latex polymers can be prepared in aqueous media using well-known free radical emulsion polymerization methods and may consist of homopolymers made from one type of the above-mentioned monomers or copolymers made from more than one type of the above-mentioned monomers. Polymers comprising monomers which form water-insoluble homopolymers are preferred, as are copolymers of such monomers. Preferred polymers may also comprise monomers which give water-soluble homopolymers, if the overall polymer composition is sufficiently water-insoluble to form a latex. Further listings of suitable monomers for addition type polymers are found in U.S. Pat. No. 5,594,047 incorporated herein by reference. The polymer can be prepared by emulsion polymerization, solution polymerization, suspension polymerization, dispersion polymerization, ionic polymerization (cationic, anionic), Atomic Transfer Radical Polymerization, and other polymerization methods known in the art of polymerization.

In one embodiment of the invention, the hydrophobic polymer can be selected so that fusing is not required, a potentially significant advantage compared to the prior art, for example U.S. Pat. No. 5,856,051, mentioned above. It has been found that once the gelatin is hydrolyzed and degraded by proteolytic enzyme treatment during manufacture and removed during photographic processing or additional washing, selected hydrophobic particles can coalesce without fusing (which they would not do in the absence of the enzyme treatment of the gelatin). Thus, the selection of hydrophobic particles to be used in the overcoat is based on the material properties one wishes to have as the protective overcoat.

A particularly preferred class of polymers for use in this invention is water dispersible polyurethanes, preferably segmented polyurethancs. Polyurethanes arc the polymerization reaction product of a mixture comprising polyol monomers and polyisocyanate monomers. A preferred segmented polyurethane is described schematically by the following structure (I):

-continued

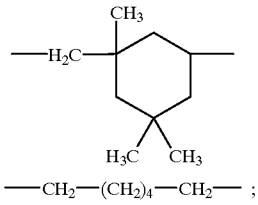

and wherein A represents a polyol, such as (a) a dihydroxy polyester obtained by esterification of a dicarboxylic acid such as succinic acid, adipic acid, suberic acid, azelaic acid, sebacic acid, phthalic, isophthalic, terephthalic, tetrahydrophthalic acid, and the like, and a diol such as ethylene glycol, propylene-1,2-glycol, propylene-1,3-glycol, diethylene glycol, butane-1,4-diol, hexane-1,6-diol, octane-1,8-diol, neopentyl glycol, 2-methyl propane-1,3-diol, or the various isomeric bis-hydroxymethylcyclohexanes; (b) a polylactone such as polymers of ϵ-caprolactone and one of the above mentioned diols; (c) a polycarbonate obtained, for example, by reacting one of the above-mentioned diols with diaryl carbonates or phosgene; or (d) a polyether such as a polymer or copolymer of styrene oxide, propylene oxide, tetrahydrofuran, butylene oxide or epichlorohydrin;

$R_2$ is a diamine or diol having a molecular weight less than about 500. Suitable well known diamine chain extenders useful herein include ethylene diamine, diethylene triamine, propylene diamine, butylene diamine, hexamethylene diamine, cyclohexylene diamine, phenylene diamine, tolylene diamine, xylylene diamine, 3,3'-dinitrobenzidene, ethylene methylenebis(2-chloroaniline), 3,3'-dichloro-4,4'-biphenyl diamine. 2,6-diaminopyridine, 4,4'-diamino diphenylmethane, and adducts of diethylene triamine with acrylate or its hydrolyzed products. Also included are materials such as hydrazine, substituted hydrazines such as, for example, dimethyl hydrazine, 1,6-hexamethylene-bis-hydrazine, carbodihydrazide, hydrazides of dicarboxylic acids and sulfonic acids such as adipic acid mono- or dihydrazide, oxalic acid Structure I

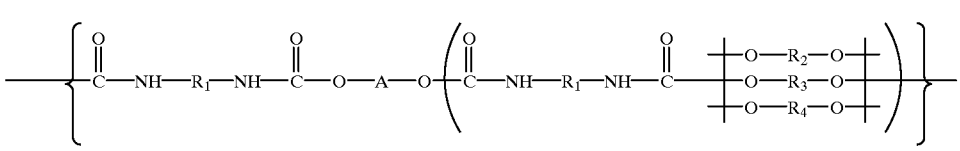

wherein $R_1$ is preferably a hydrocarbon group having a valence of two, more preferably containing a substituted or unsubstituted, cyclic or non-cyclic, aliphatic or aromatic group, most preferably represented by one or more of the following structures:

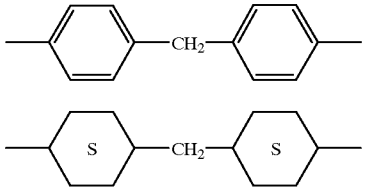

dihydrazide, isophthalic acid dihydrazide, tartaric acid dihydrazide, 1,3-phenylene disulfonic acid dihydrazide, omega-amino-caproic acid dihydrazide, hydrazides made by reacting lactones with hydrazine such as gamma-hydroxylbutyric hydrazide, bis-semicarbazide, bis-hydrazide carbonic esters of glycols such as any of the glycols mentioned above. Suitable well known diol chain extenders may be any of the glycols or diols listed above for A. $R_3$ is a phosphonate, carboxylate or sulfonate group.

$R_3$ contains a phosphonate, carboxylate or sulfonate group; and $R_4$ is an divalent alkylpolyether, for example, 3-oxopentane-1,5-diyl.

The number of repeating units of Structure I can range from 2 to 200, preferably 20 to 100. The amount of the hard-segment (in the right-hand parenthesis) is preferably 40 to 70 percent by weight. The weight ratio of the $OR_3O$ to the $OR_2O$ repeating unit preferably varies from 0 to 0.1.

The water-dispersible polyurethane employed in the invention may be prepared as described in "Polyurethane Handbook," Hanser Publishers, Munich Vienna, 1985.

The enzymes used in this invention include any proteolytic enzyme, enzyme preparation, or enzyme-containing formulation capable of dissolving or degrading gelatin. Thus, "enzyme" in the context of this invention includes crude proteolytic enzyme preparations, such as crude plant or bacterial fermentation broth extracts, as well as purified enzymes from plant, animal, or bacterial sources. The preparations of enzyme usable in the process are understood to include activators, cofactors, and stabilizers that are required for enzymatic activity, as well as stabilizers that enhance or preserve its activity. Examples of suitable enzymes include serine proteases such as Esperase©, Alcalase©, and Savinase© (commercial enzyme preparations from Novo Nordisk Corporation); Multifect P-3000©, HT Proteolytic 200©, Protex 6L© and Protease 899© (commercial enzyme preparations from Genencor International Corporation); sulfhydryl proteases such as papain and bromelain; and metaloproteases such as Neutrase© (a commercial bacterial metaloenzyme preparation from Novo Nordisk Corporation). The use of combinations of these enzymes and enzyme types are also envisaged under this invention. Adducts of enzymes with synthetic polymers are also envisaged in which enzyme molecules are attached to synthetic polymers, which polymers may be larger or smaller than the enzyme.

The coating composition of the invention is advantageously applied by any of a number of well known techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in *Research Disclosure* No. 308119, Published December 1989, pages 1007 to 1008.

In manufacturing the photographic element, the incorporated enzyme is in reactive association with the gelatin in the overcoat (nascent protective overcoat) but need not be in the same layer with the gelatin. Thus, a separate layer containing the enzyme, typically in combination with a hydrophilic polymer, can be applied (preferably over the overcoat). The hydrophilic polymer can be natural (for example, a starch or starch derivative) or synthetic (for example, polyvinyl alcohol). The protective overcoat and enzyme can be applied separately from the imaging layer. The enzyme/overcoat can be applied in-line at a separate coating station after the topmost imaging layer is applied and allowed to dry. This can be referred to as a "two-pass" sequential operation. Alternatively, the enzyme can be applied separately (in a separate operation) from the imaging layer after the imaging layer has been allowed to harden. The latter manufacturing scheme has the disadvantage, however, that additionalinventory is required.

The hardener for the imaging layers can be contained in any one or combination of layers, including interlayers between imaging layers. The hardener may be applied in the layer that is most convenient, since the hardener can diffuse to the imaging layers to provide the necessary or appropriate hardening. For example, the hardener may be in the overcoat or in a separate enzyme-containing layer. Alternately, the hardener may be applied in a non-image gelatin layer ("gelatin pad"). Optionally a non-image gelatin pad can be placed between the imaging layers and the overlaying enzyme layer and/or overcoat as a barrier to prevent enzyme from attacking or degrading the gelatin in the underlying imaging layer.

Most preferably, however, all the layers comprising the photographic element (including the imaging layers, overcoat layer, and the layer containing enzyme) are applied simultaneously. A significant advantage of the present invention is that the coating solution for the overcoat of this invention is water-based and gels on cooling, which means that the invention can thus be incorporated into the traditional manufacturing coating operation of photographic paper, for example, without any equipment modification. The presence of 10–50% by weight of gelatin is sufficient to maintain proper permeability for processing solution to diffuse in and out for image development. Most preferably, the coatings are simultaneously applied at a single coating station by a slide hopper.

It is desirable to formulate an enzyme solution with acceptable enzyme activity for an extended period of time. Compounds to stabilize enzyme activity of liquid proteolytic enzyme solutions arc well known. A few examples are cited here for references. U.S. Pat. No. 4,238,345 describes the use of antioxidant, hydrophilic polyols and pH buffer to stabilize proteolytic enzyme used in detergents. U.S. Pat. No. 4,243,546 teaches the use of alkanolamine and an organic or inorganic acid to stabilize enzyme activity in an aqueous detergent composition. U.S. Pat. No. 4,318,818 describes an enzyme stabilizing system comprising calcium ions and a low molecular weight carboxylic acid salt, preferably with a low molecular weight alcohol and pH between 6.5 to 10. U.S. Pat. No. 4,532,064 discloses a mixture of boron compounds, reducing salt and dicarboxylic acid to stabilize enzyme in liquid detergent. U.S. Pat. No. 4,842,767 describes the use of cascin to stabilize the enzyme in liquid detergent. U.S. Pat. No. 5,840,677 describes the use of boronic acid or borinic acid derivatives as enzyme stabilizers. U.S. Pat. No. 5,612,306 describes the combination of at least one chelating agent and at least one nonionic surfactant as the enzyme stabilizing system. Other means of enzyme stabilization can be found in U.S. Pat. Nos. 5,877,141, 5,904,161, 5,269,960, 5,221,495, 5,178,789, 5,039,446, 4,900,475, and the like.

Optionally there can be incorporated into the overcoat composition a dye that will impart color or tint. In addition, additives can be incorporated into the composition that will give the overcoat various desired properties. For example, a UV absorber may be incorporated into the polymer to make the overcoat UV absorptive, thus protecting the image from UV induced fading. Other compounds may be added to the coating composition, depending on the functions of the particular layer, including surfactants, emulsifiers, coating aids, lubricants, matte particles, rheology modifiers, crosslinking agents, antifoggants, inorganic fillers such as conductive and nonconductive metal oxide particles, pigments, magnetic particles, biocide, and the like. The coating composition may also include a small amount of organic solvent; preferably the concentration of organic solvent is less than 5 percent by weight of the total coating composition.

Examples of coating aids include surfactants, viscosity modifiers and the like. Surfactants include any surface-active material that will lower the surface tension of the coating preparation sufficiently to prevent edge-withdrawal, repcllencies, and other coating defects. These include alkyloxy- or alkylphenoxypolyether or polyglycidol derivatives and their sulfates, for example a nonylphenoxypoly (glycidol) such as Olin 10G™, available from Olin Matheson Corporation, or sodium octylphenoxypoly (ethyleneoxide) sulfate, organic sulfates or sulfonates, such as sodium dodecyl sulfate, sodium dodecyl sulfonate, sodium bis(2-ethylhexyl)sulfosuccinate, and alkylcarboxylate salts such as sodium decanoate.

The surface characteristics of the protective overcoat arc in large part dependent upon the physical characteristics of the polymer used. However, the surface characteristics of the overcoat also can be modified by the conditions under which the surface is optionally fused. For example, in contact fusing, the surface characteristics of the fusing element that is used to fuse the polymers to form the continuous overcoat layer can be selected to impart a desired degree of smoothness, texture or pattern to the surface of the element. Thus, a highly smooth fusing element will give a glossy surface to the imaged element, a textured fusing element will give a matte or otherwise textured surface to the element, a patterned fusing element will apply a pattern to the surface of the element, etc.

Matte particles well known in the art may also be used in the coating composition of the invention, such matting agents have been described in *Research Disclosure* No. 308119, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include hydroxyl, carboxyl, carboduimide, epoxide, aziridine, vinyl sulfone, sulfinic acid, active methylene, amino, amide, allyl, and the like.

In order to reduce the sliding friction of the photographic elements in accordance with this invention, the overcoat composition may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004,927, and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,320,565; and 1,320,756; and in German Patent Nos. 1,284,295 and 1,284,294; (3) liquid paraffin and paraffin or wax like materials such as carnauba wax, natural and synthetic waxes, petroleum waxes, mineral waxes, silicone-wax copolymers and the like; (4) perfluoro- or fluoro- or fluorochloro-containing materials, which include poly(tetrafluoroethylene), poly (trifluorochloroethylene), poly(vinylidene fluoride, poly (trifluorochloroethylene-co-vinyl chloride), poly(meth) acrylates or poly(meth)acrylamides containing perfluoroalkyl side groups, (5) polyethylene, and the like. Lubricants useful in the present invention are described in further detail in *Research Disclosure* No. 308119, published December 1989, page 1006.

The laydown of the overcoat will depend on its field of application. For a photographic element, the total dry laydown is suitably 50 to 600 mg/ft$^2$, most preferably 100 to 300 mg/ft$^2$. It may be advantageous to increase the amount of gelatin in the overcoat as the laydown increases in order to improve the developability. The higher the laydown of the hydrophobic polymer component, the better the water resistance. On the other hand, increasing the laydown of hydrophobic particles, at some point, may tend to slow down the photographic development.

After applying the coating composition to the support, it may be dried over a suitable period of time, for example 2 to 4 minutes.

Photographic elements of this invention can differ widely in structure and composition. For example, the photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure*, Item 36230 (June 1994). Photographic elements can be either simple black-and-white or monochrome elements or multilayer and/or multicolor elements adapted for use in a negative-positive process or a reversal process. Generally, the photographic element is prepared by coating one side of the film or paper support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure*, Vol. 176, Item 17643 (December 1978).

Photographic elements protected in accordance with this invention can be derived from silver halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion picture prints or they can be imaged elements that are viewed by reflection, such as paper prints. Because of the amount of handling that can occur with paper prints and motion picture prints, they are the preferred photographic elements according to the present invention.

The photographic elements in which the images to be protected are formed can have the structures and components shown in Research Disclosure 37038 and 38957. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

The element can contain additional layers, such as filter layers, interlayers, overcoat layers, subbing layers, and the like. All of these can be coated on a support which can be transparent (for example, a film support) or reflective (for example, a paper support). Support bases that can be used include both transparent bases, such as those prepared from polyethylene terephthalate, polyethylene naphthalate, cellulosics, such as cellulose acetate, cellulose diacetate, cellulose triacetate, and reflective bases such as paper, coated papers, meltextrusion-coated paper, and laminated papers, such as those described in U.S. Pat. Nos. 5,853,965; 5,866,282; 5,874,205; 5,888,643; 5,888,681; 5,888,683; and 5,888,714. Photographic elements protected in accordance with the present invention may also include a magnetic recording material as described in *Research Disclosure*, Item 34390, November 1992, or a transparent magnetic recording layer such as a layer containing magnetic particles on the underside of a transparent support as described in U.S. Pat. No. 4,279,945 and U.S. Pat. No. 4,302,523.

Suitable silver halide emulsions and their preparation, as well as methods of chemical and spectral sensitization, are described in Sections I through V of Research Disclosure 37038 (or 38957). Color materials and development modifiers are described in Sections V through XX of Research Disclosure 37038. Vehicles are described in Section II of Research Disclosure 37038, and various additives such as brighteners, antifoggants, stabilizers, light absorbing and scattering materials, hardeners, coating aids, plasticizers, lubricants and matting agents are described in Sections VI through X and XI through XIV of Research Disclosure 37038. Processing methods and agents are described in Sections XIX and XX of Research Disclosure 37038, and methods of exposure are described in Section XVI of Research Disclosure 37038.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders arc hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process*, 4th Edition, Macmillan, N.Y., 1977. In the case of processing a color negative element, the element is treated with a color developer (that is one which will form the colored image dyes with the color couplers), and then with an oxidizer and a solvent to remove silver and silver halide. In the case of processing a color reversal element or color paper clement, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver and silver halide, washing and drying.

In one embodiment of a method of using a composition according to the present invention, a photographic element may be provided with an cnzyme-treated, processing-solution-permeable overcoat having the above described composition overlying the silver halide emulsion layer superposed on a support. The photographic clement is developed in an alkaline developer solution having a pH greater than 7, preferably greater than 8, more preferably greater than 9. This allows the developer to penetrate the protective coating.

The overcoat layer in accordance with this invention is particularly advantageous for use with photographic prints due to superior physical properties including excellent resistance to water-based spills, fingerprinting, fading and yellowing, while providing exceptional transparency and toughness necessary for providing resistance to scratches, abrasion, blocking, and ferrotyping.

The polymer overcoat may be further coalesced by fusing (heat and/or pressure) if needed after processing without substantial change or addition of chemicals in the processing step to form a fully water impermeable protective overcoat with excellent gloss characteristics. Optional fusing may be carried out at a temperature of from 35 to 175 ° C.

The present invention is illustrated by the following Examples.

EXAMPLES

This example illustrates the preparation of various water-dispersible polymers that can be used in a protective overcoat according to the present invention.

Preparation of Polyurethane Polymer PU-1:

In a 5 liter resin flask equipped with thermometer, stirrer, water condenser and vacuum outlet was placed 113.52 g (0.132 mole) polycarbonate polyol PC-1733©, from Stahl USA, Inc. (Mw=860). This material was melted and dewatered under vacuum at 100° C. The vacuum was released and 15.29 g (0.114 mole) dimethylol propionic acid, 45.42 g (0.504 mole) 1,4-butanediol, 10.22 g catalyst dibutyltin dilaurate, and 600 g of tetrahydrofuran that had been placed over Molecular Sieves were added at 60° C. The temperature was adjusted to 75° C. for 30 minutes until reaction was thoroughly mixed and then lower to 60° C. With continued stirring 166.72 (0.75mole) of Isophrone Diisocyanate was added dropwisc. Increase temperature to 85° C. and maintained until the isocyanate functionality is substantially consumed. A stoichometric amount of potassium hydroxide based on dimethylol propionic acid was stirred in, and maintained for 5 minutes. An amount of water five times the amount of tetrahydrofuran (by weight) was mixed under high shear to form a stable aqueous dispersion. The tetrahydrofuran was removed by evaporation under reduced pressure.

Preparation of Polyurethane Polymer PU-2:

This polyurethane was prepared using the same procedure as PU-1 but 3% by weight of sodium dioctyl sulfosuccinate (Aerosol® OT) was dissolved in the urethane prior to neutralization of the acid component. The polymer was then dispersed under high shear.

Preparation of Polyurethane Polymer PU-3:

This polyurethane was prepared using the same procedure as PU-2 but 1 wt % of Triton 770 (30% solids) was used as the stabilizing surfactant.

Preparation of Water-dispersible Polyurethane Polymer PU-4:

This polyurethane was prepared using the same procedure as PU-1, with the following modifications: 529.76 g (0.616 mole) polycarbonate polyol KM101733 is used as the polyol, 71.4 g (0.532 mole) dimethylol propionic acid, 152.67 g (1.694 mole) 1,4-butanediol, 70 g (0.658 mole) diethylene glycol are used as the chain extender. 1 wt % of Triton® 770 (30% solids) was used as the stabilizing surfactant.

Preparation of Vinyl Latex Polymer VL-1, Poly(ethyl acrylate)-co-(vinylidene chloride)-co-(hydroxyethyl acrylate):

To a 20-ounce polyethylene bottle was added 341 g of demineralized water. The water was purged for 15–20 minutes with nitrogen. The following were added to the reactor in order: 5.10 g 30% Triton®770, 3.06 g hydroxyethyl acrylate, 15.29 g ethyl acrylate, 134.59 g vinylidene chloride, 0.7586 g potassium metabisulfite, and 0.3794 g potassium persulfate. The bottle was capped and placed in a tumbler bath at 40° C., and held there for 16–20 hours. The product was then removed from the bath, and cooled to 20° C. The product was filtered through cheesecloth. Glass transition temperature was 9° C. as measured by DSC, average particle size obtained from PCS was 75 nm.

Testing and Evaluation:

The performance of the overcoats in the following examples was evaluated by testing its ability to prevent staining of the underlying gelatin layers by a solution of Ponceau Red S in 5% acetic acid and water. This dye binds strongly to gelatin, resulting in a deep red coloration. An effective barrier overcoat will prevent the dye from contact with underlying gelatin layers, and will therefore prevent the formation of this color. The processed coatings were soaked in this solution for various lengths of time, washed in water, and dried. The performance of the overcoat was rated according to the following rating scheme:

| Rating | Protective properties | Rating | Structural integrity of coating |
|---|---|---|---|
| A | good performance; no stain visible | 1 | good performance; coating structure intact |
| B | occasional light pink patches | 2 | overcoat patchy; some peeling, usually from edges. |
| C | overall light pink stain | 3 | overcoat adheres poorly, in some cases becoming a freely floating film |

-continued

| Rating | Protective properties | Rating | Structural integrity of coating |
|---|---|---|---|
| D | bright red; like a check coating without overcoat. No protection. | 4 | upper layers of coating structure digested; cyan layer partially or totally removed |
| | | 5 | cyan and magenta layers partially or totally removed |
| | | 6 | all gelatin layers removed down to support |

Each processed and dyed strip was ranked by the above scheme, first according to the barrier properties of its overcoat, and then with respect to the integrity of the coating. Proteolytic enzymolysis is a well-known way of dissolving hardened gelatin coatings. It is therefore not surprising that prolonged treatment with such enzymes will produce a structure in which the various emulsion layers are removed during processing. It is more surprising that in certain cases good barrier properties could be obtained from the overcoat even when some of the underlying layers of the structure had been removed during processing. Thus it is possible for a coating to have a rating such as A4, indicating good barrier properties, but also that the cyan imaging layer had been removed. Also, it was observed in certain cases that the barrier layer adhesion to the underlying structure was poor after processing, presumably because the gelatin layers immediately underneath the overcoat had been digested by the enzyme and dissolved. In these cases, peeling or complete detachment of the overcoat layer was observed, usually accompanied by dissolution of some of the underlying emulsion layers. When the coating was dried (and fused, if appropriate), occasionally the overcoat layer was reattached, and sometimes gave good barrier properties. If this kind of behavior was observed, the coating was given a rating such as B2,4, indicating that the overcoat layer had become detached, and the underlying layers partially digested (to the magenta layer in this case), but that the portion of the coating in which the overcoat remained attached (or had become reattached on drying) had reasonably good barrier properties (occasional light pink staining by Ponceau red). Appending superscripts to the symbols allowed finer distinctions (e.g., $B^{+}3^{-}$). This is done in the examples to make comparisons between coatings or treatments within a given set. For example, the following sequence would represent incremental improvements in performance in an experimental series: B3, $B^{+}3^{-}$, A2, A1.

A rating of A1 is the most desirable result, but rainkings showing greater permeability to the dye (B or C) are still indicative of substantial barrier performance on the part of the overcoat. A coating without any kind of enzyme treatment, or without a barrier layer altogether, will have a ranking of D1.

The above scheme could be used fully only with coatings over a full imaging rug, and required processing of both exposed and unexposed coatings in a solution containing color developer. Examination of the exposed coatings after processing allowed the detection of digestion of the imaging layers by the color of the sample. A coating with all imaging layers intact appeared black under these conditions. A coating with the cyan imaging layer partially or completely removed was red or showed red areas; a coating with both cyan and magenta imaging layers partially or completely removed was yellow; and a coating with all of the imaging layers removed was white. Barrier properties of the overcoat were evaluated by processing unexposed coatings (which were colorless after processing) and then soaking in Ponceau Red S solution for 5 minutes. Control coatings, or very permeable ones with overcoat layers lacking barrier properties, were stained dark red by this procedure. Coatings with overcoats that had good barrier properties (or coatings in which all of the emulsion layers had been removed) remained white.

Trial coatings in which the overcoat was applied over structures without imaging chemistry (a gelatin-only rug) were evaluated by a variation of this scheme. The barrier property evaluation was unaffected. Structural integrity ratings were restricted to ratings 1, 2, 3, or 6.

Preparation of the Photographic Samples:

Multilayer Support S-1 was prepared by coating in sequence a blue-light sensitive layer, an interlayer, a green-light sensitive layer, a UV layer, a red-light sensitive layer, a UV layer and an overcoat on photographic paper support. The components in each individual layer are described below.

| | Item | Laydown ($mg/ft^2$) |
|---|---|---|
| Layer | Blue Sensitive Layer | |
| 1 | Gelatin | 121.90 |
| | Blue-light sensitive AgX | 21.10 |
| | Y-1 | 38.50 |
| | Di-n-butyl phthalate | 17.33 |
| | ST-23 | 38.50 |
| | ST-16 | 0.88 |
| | Benzenesulfonic acid, 2,5-dihydroxy-4-(1-methylheptadecyl)-, monopotassium salt | 0.88 |
| | 1-Phenyl-5-mercaptotetrazole | 0.013 |
| Layer | Interlayer | |
| 2 | Gelatin | 70.00 |
| | ST-4 | 6.13 |
| | Di-n-butyl phthalate | 17.47 |
| | Disulfocatechol disodium | 6.00 |
| | Nitric acid | 0.524 |
| | SF-1 | 0.18 |
| Layer | Green Sensitive Layer | |
| 3 | Gelatin | 132.00 |
| | Green-light sensitive AgX | 7.30 |
| | M-1 | 22.10 |
| | Di-n-butyl phthalate | 7.85 |
| | Diundecyl phthalate | 3.36 |
| | ST-1 | 16.83 |
| | ST-2 | 5.94 |
| | ST-3 | 56.09 |
| | 1-Phenyl-5-mercaptotetrazole | 0.05 |
| Layer | UV Layer | |
| 4 | Gelatin | 66.00 |
| | UV-1 | 15.98 |
| | UV-2 | 2.82 |
| | ST-4 | 5.14 |
| | Di-n-butyl phthalate | 3.13 |
| | 1,4-Cyclohexylenedimethylene bis(2-ethylhexanoate) | 3.13 |
| Layer | Red Sensitive Layer | |
| 5 | Gelatin | 126.0 |
| | Red-light sensitive AgX | 18.70 |
| | C-1 | 35.40 |
| | Di-n-butyl phthalate | 34.69 |
| | 2-(2-Butoxyethoxy)ethyl acetate | 2.90 |
| | ST-4 | 0.29 |
| | UV-1 | 22.79 |
| | Silver phenyl mercaptotetrazole | 0.05 |
| | Benzenesulfonothioic acid, 4-methyl-, potassium salt | 0.26 |
| Layer | UV Layer | |
| 6 | Gelatin | 50.00 |
| | UV-1 | 12.11 |

-continued

| | Item | Laydown ($mg/ft^2$) |
|---|---|---|
| | UV-2 | 2.13 |
| | ST-4 | 3.90 |
| | Di-n-butyl phthalate | 2.37 |
| | 1,4-Cyclohexylenedimethylene bis(2-ethylhexanoate) | 2.37 |
| Layer | Overcoat | |
| 7 | Gelatin | 60.0 |
| | SF-1 | 1.00 |
| | SF-2 | 0.39 |
| | Bis(vinylsulfonyl)methane | 9.14 |

The Photographic Paper Support:

Sublayer 1: resin coat (Titanox and optical brightener in polyethylene)

Sublayer 2: paper

Sublayer 3: resin coat (polyethylene)

SF-1

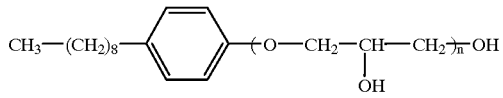

SF-2 $CF_3.(CF_2)_7.SO_3Na$

UV-1

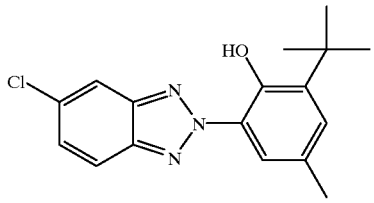

UV-2

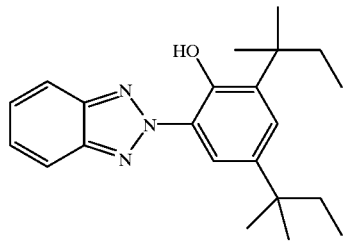

C-1

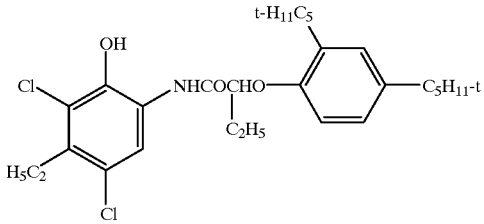

M-1

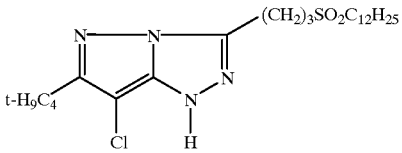

-continued

ST-1

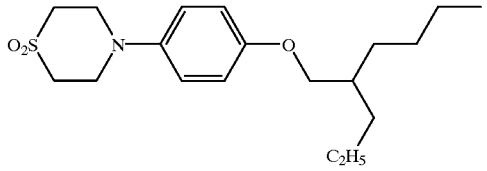

ST-2

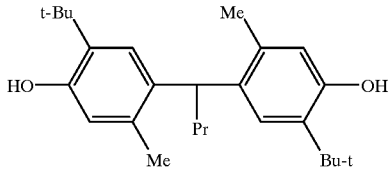

ST-3

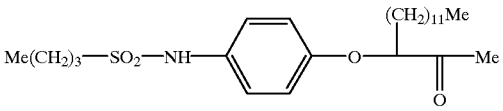

ST-4

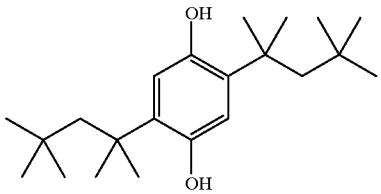

Y-1

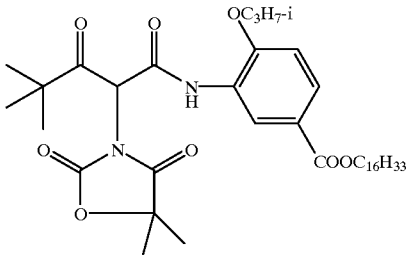

ST-16

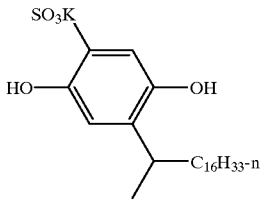

ST-23

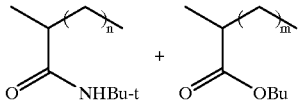

n:m = 1:1; MW = 75,000–100,000 n:m = 1:1; MW = 75,000–100,000

Example 1

This example illustrates (without imaging layers) the controlled digestion of gelatin in an overcoat used in the present invention. Coatings were prepared in which each layer was coated using an extrusion hopper as a separate pass. In this coating and in later coatings, BVSM stands for bis(vinyl sulfonyl)methane, a gelatin crosslinking agent. The following three-layer format was used.

| |
|---|
| Third-pass Layer |
| water (control) or<br>enzyme Solution (invention) |
| Second-pass Layer |
| 160 mg/ft$^2$ Polymer VL- 1<br>40 mg/ft$^2$ gelatin<br>5.1 mg/ft$^2$ BVSM |
| First-pass Layer |
| 300 mg/ft$^2$ gelatin<br>7 mil Estar © support |

The coating machine was equipped with a chill box and two dryer sections, in which the conditions were varied as indicated in the Table below. Each coating variation was processed at 40° C. using the following protocol similar to RA-4):

| | |
|---|---|
| 1. Kodak T213 © developer | Variable time |
| 2. Bleach/fix | 45 sec |
| 3. wash | 3 minutes |
| 4. Airdry | |
| 5. Fuse at 320° F./1 ips wherein ips is inches per second. | |
| 6. Stain with solution of Ponceau Red S in 5% Acetic acid. | |

The dryer conditions varied somewhat between runs. For the runs in Table 1, the dryer conditions were (1) Chill box: 70° F./70% RH, (2) First dryer section: 70° F./10% RH, and (3) Second dryer section: 70° F./10% RH. For the runs in Table 2, the dryer conditions were: (1) Chill box: 70° F./10% RH, (2) First dryer section: 70° F./10% RH, and (3) Second dryer section: 70° F./10% RH. For the runs in Table 3, the dryer conditions were (1) Chill box: 120° F./<10% RH, (2) First dryer section: 70° F./10% RH, and (3) Second dryer section: 70° F./10% RH (relative humidity).

The amount of red dye taken up by the coating is an indication of the barrier properties afforded by the overcoat layer applied in the second pass. The results of the coatings evaluation and testing were as follows:

TABLE 1

| Run | Feature | Time in developer 0 | 15 s | 30 s | 60 s | 120 s | 240 s |
|---|---|---|---|---|---|---|---|
| 1 | 2.0 mL/ft$^2$ water overcoat (control) | D1 | D1 | D1 | D1 | D1 | D1 |
| 2 | 2.0 mL/ft$^2$ Esperase 8.0 L diluted 1/10 (invention) | D1 | A1 | A1 | A1 | A2 | A2$^+$ |
| 3 | 2.0 mL/ft$^2$ Esperase 8.0 L diluted 1/100 (invention) | D1 | C1 | B1 | B1 | B1 | B1 |
| 4 | 2.0 mL/ft$^2$ Esperase 8.0 L diluted 1/300 | D1 | D1 | D1 | D1 | D1 | D1 |
| 5 | 2.0 mL/ft$^2$ Esperase 8.0 L diluted 1/1000 | D1 | D1 | D1 | D1 | D1 | D1 |

TABLE 2

| Run | Feature | Time in developer 0 | 15 s | 30 s | 60 s | 120 s | 240 s |
|---|---|---|---|---|---|---|---|
| 6 | 2.0 mL/ft$^2$ water overcoat (control) | D1 | D1 | D1 | D1 | D1 | D1 |
| 7 | 2.0 mL/ft$^2$ Esperase 8.0 L diluted 1/10 (invention) | D1 | A1 | A1 | A1 | A1 | A2 |
| 8 | 2.0 mL/ft$^2$ Esperase 8.0 L diluted 1/100 (invention) | D1 | C1 | C1 | B1 | B1 | A1 |
| 9 | 2.0 mL/ft$^2$ Esperase 8.0 L diluted 1/300 (invention) | D1 | D1 | D1 | D1 | D1 | C1 |
| 10 | 2.0 mL/ft$^2$ Esperase 8.0 L diluted 1/1000 (invention) | D1 | D1 | D1 | D1 | D1 | D1 |

TABLE 3

| Run | Feature | Time in developer 0 | 15 s | 30 s | 60 s | 120 s | 240 s |
|---|---|---|---|---|---|---|---|
| 11 | 2.0 mL/ft$^2$ Esperase 8.0 L diluted 1/1000 (invention) | D1 | D1 | D1 | D1 | D1 | D1 |
| 12 | 2.0 mL/ft$^2$ Esperase 8.0 L diluted 1/100 (invention) | C1 | C1 | B1 | B1 | B1 | B$^+$1 |
| 13 | 2.0 mL/ft$^2$ water(contro1) | D1 | D1 | D1 | D1 | D1 | D1 |

As can be seen by the results obtained for coatings parts 1, 6 and 13, in which a water solution containing no enzyme is applied to the structure, without enzyme, no barrier properties are exhibited by the polymer, even after fusing at high temperature. However, when a protease enzyme solution of sufficient activity is applied (runs 2, 3, 6, 7, and 12), the coating becomes impermeable after processing and fusing, and no dye uptake is observed. The degree of impermeability is related to the amount of enzyme coated, so that more dilute enzyme solutions are less active, and either take a longer time on soaking in developer solution to develop the ability to form an effective barrier, or do not form such a barrier at all. In this experiment, a laydown of Esperase 8.0L of at least 20 mg/ft$^2$ was required such that effective barrier properties were obtained.

Similar results are obtained when the coatings are processed using a pilot Color Paper machine developer using the RA-4 process. Once again, the dried coatings were fused at 320° F./1 ips and soaked in Ponceau Red dye solution to test the protective properties of the overcoat. The results in Table 3 below confirm the conclusions obtained above in each case.

TABLE 4

| Run | Feature | Rating |
|---|---|---|
| 1-1 | 2.0 mL/ft$^2$ water overcoat (control) | D1 |
| 1-2 | 2.0 mL/ft$^2$ Esperase 8.0 L diluted 1/10 (invention) | A1 |
| 1-3 | 2.0 mL/ft$^2$Esperase 8.0 L diluted 1/100 (invention) | B1 |
| 1-4 | 2.0 mL/ft$^2$ Esperase 8.0 L diluted 1/300 (invention) | D1 |
| 1-5 | 2.0 mL/ft$^2$ Esperase 8.0 L diluted 1/1000 (invention) | D1 |
| 1-6 | 2.0 mL/ft$^2$ water overcoat (control) | D1 |
| 1-7 | 2.0 mL/ft$^2$ Esperase 8.0 L diluted 1/10 (invention) | A1 |
| 1-8 | 2.0 mL/ft$^2$ Esperase 8.0 L diluted 1/100 (invention) | B1 |
| 1-9 | 2.0 mL/ft$^2$ Esperase 8.0 L diluted 1/300 (invention) | D1 |
| 1-10 | 2.0 mL/ft$^2$ Esperase 8.0 L diluted 1/1000(invention) | D1 |
| 1-11 | 2.0 mL/ft$^2$ Esperase 8.0 L diluted 1/1000 (invention) | D1 |
| 1-12 | 2.0 mL/ft$^2$ Esperase 8.0 L diluted 1/100 (invention) | B$^+$1 |
| 1-13 | 2.0 mL/ft$^2$ water (control) | D1 |

Example 2

This Example illustrates overcoats used in the present invention, and the effect of varying the concentration of the enzyme and the thickness of the overcoat. In a first step, a multilayer photographic imaging element (support S-1) was prepared using slide-hopper coating techniques. Over this element, in a first pass, a suspension of barrier polymer and gelatin at a weight ratio of 4/1 in water was applied at three different levels. Enzyme solutions in water at various concentrations were applied in a second pass. Two identical first-pass coatings were made, but at different times. One such set of coatings was prepared a week before the application of the second pass (the enzyme/water overcoat) and was allowed to stand at room temperature. In this period of time the gelatin in the structure becomes firmly crosslinked by the hardening agent (BVSM). Another identical set was prepared the same day as the application of the second pass. The second set is only weakly crosslinked by the hardener at the time of application of the enzyme solutions of the invention. In the second pass, the enzyme solution is applied at several different concentrations and at several different total laydowns as indicated in the Table.

| | | |
|---|---|---|
| Second-pass Layer | | |
| water (control) or enzyme solution (invention) | | |
| First-pass Layer | | |
| 160 mg/ft2 VL-1 | 120 mg/ft VL-1 | 80 mg/ft VL-1 |
| 40 mg/ft gelatin | 30 mg/ft gelatin | 20 mg/ft gelatin |
| 11.4 mg/ft BVSM | 9.5 mg/ft BVSM | 9.3 mg/ft BVSM |
| Multilayer support S-1 | | |

After application of the second pass, the coatings were allowed to cure at room temperature, and then processed in RA-4 chemistry as described in Example 1. One set was processed after 2 days of curing, when the gelatin in the structure is crosslinked (hardened) sufficiently so that it will not normally dissolve during photographic processing, but is not fully hardened. Another set was allowed to cure for 20 days before processing, to allow the gelatin crosslinking reaction to proceed essentially to completion. The coatings were processed using RA-4 chemistry. For each variation, two samples were processed, one of which was protected from light so that no dyes were formed on processing, and the coating appeared to be white (D-min processing). The other set of samples was exposed to white light before processing, so that dyes were formed, and the coating would normally (i.e., without the overcoat layer, and without application of the enzyme) appear to be black (D-max processing). The formation of dyes during processing indicates that normal photographic processing occurred, and that the protective layer has not prematurely formed a barrier to the passage of photographic chemicals. None of the samples of this example showed evidence that photographic development was substantially impeded by the barrier layer. Evaluation of the protective function of the barrier layer was made by soaking the D-min processed strips in Ponceau Red solution as described in Example 1. D-max processed samples were examined for evidence of loss of the imaging layers because of excessive enzymolysis. The results are shown in Tables 4 and 5 below. For the runs in Table 4, namely runs 1–10 and 13, the overcoat plus crosslinking agent was applied on the same day as the enzyme solution. For the runs in Table 5, namely runs 16–25 and 28, the overcoat plus crosslinking agent was applied 8 days prior to overcoating with the enzyme solution.

TABLE 4

| Run | Feature (first pass; second pass) | Enzyme solution laydown (mg/ft$^2$ 2) | Rating: Processed after 2 days, fused (320° F., 1 ips) | Rating: Processed after 20 days, Fused (320° F., 1 ips) |
|---|---|---|---|---|
| 2-0 | 200 mg/ft$^2$ VL-1/gel 4/1; no overcoat (control) | 0 | D1 | D1 |
| 2-1 | 200 mg/ft$^2$ VL-1/gel 4/1; 1 mL/ft$^2$ Esperase 8L (1/10) | 100 | B4 | A4 |
| 2-2 | 200 mg/ft$^2$ VL-1/gel 4/1; 2 mL/ft$^2$ Esperase ® 8L (1/10) | 200 | C5 | B4$^+$ |
| 2-3 | 200 mg/ft$^2$ VL-1/gel 4/1; 3 mL/ft$^2$ Esperase ® 8L (1/10) | 300 | C5 | B5 |
| 2-4 | 200 mg/ft$^2$ VL-1/gel 4/1; 1 mL/ft$^2$ Esperase ® 8L (1/30) | 33.3 | A4 | A1 |
| 2-5 | 200 mg/ft$^2$ VL-1/gel 4/1; 2 mL/ft$^2$ Esperase ® 8L (1/30) | 66.7 | B3,4 | B4 |
| 2-6 | 200 mg/ft$^2$ VL-1/gel 4/1; 3 mL/ft$^2$ Esperase ® 8L (1/30) | 100 | C3,5 | C3,4$^+$ |
| 2-7 | 200 mg/ft$^2$ VL-1/gel 4/1; 1 mL/ft$^2$ Esperase ® 8L (1/100) | 10 | C1 | B1 |
| 2-8 | 200 mg/ft$^2$ VL-1/gel 4/1; 2 mL/ft$^2$ Esperase ® 8L (1/100) | 20 | B4 | B4 |
| 2-9 | 200 mg/ft$^2$ VL-1/gel 4/1; 3 mL/ft$^2$ Esperase ® 8L (1/100) | 30 | B4 | B4 |
| 2-10 | 150 mg/ft$^2$ VL-1/gel 4/1; 1 mL/ft$^2$ Esperase ® 8L (1/10) | 100 | B3,4 | A4 |
| 2-13 | 100 mg/ft$^2$ VL-1/gel 4/1; 1 mL/ft$^2$ Esperase ® 8L (1/10) | 100 | B3,4 | B3,4 |

TABLE 5

| Run | Feature (first pass; second pass) | Enzyme solution laydown (mg/ft$^2$ 2) | Rating: Processed after 2 days fused (320° F., 1 ips) | Rating: Processed after 20 days Fused (320° F., 1 ips) |
|---|---|---|---|---|
| 2-0 | 200 mg/ft$^2$ VL-1/gel 4/1; no overcoat (control) | 0 | D1 | D1 |
| 2-16 | 200 mg/ft$^2$ VL-1/gel 4/1; 1 mL/ft$^2$ Esperase 8L (1/10) | 100 | A4 | B1 |
| 2-17 | 200 mg/ft$^2$ VL-1/gel 4/1; 2 mL/ft$^2$ Esperase 8L (1/10) | 200 | D4 | D4 |
| 2-18 | 200 mg/ft$^2$ VL-1/gel 4/1; 3 mL/ft$^2$ Esperase 8L (1/10) | 300 | D4 | D4 |
| 2-19 | 200 mg/ft$^2$ VL-1/gel | 33.3 | B3,4$^+$ | A1 |

TABLE 5-continued

| Run | Feature (first pass; second pass) | Enzyme solution laydown (mg/ft$^2$ 2) | Rating: Processed after 2 days fused (320° F., 1 ips) | Rating: Processed after 20 days Fused (320° F., 1 ips) |
|---|---|---|---|---|
| 2-20 | 4/1; 1 mL/ft$^2$ Esperase 8L (1/30) 200 mg/ft$^2$ VL-1/gel 4/1; 2 mL/ft$^2$ Esperase 8L (1/30) | 66.7 | D4 | D4 |
| 2-21 | 200 mg/ft$^2$ VL-1/gel 4/1; 3 mL/ft$^2$ Esperase 8L (1/30) | 100 | D4 | D4 |
| 2-22 | 200 mg/ft$^2$ VL-1/gel 4/1; 1 mL/ft$^2$ Esperase 8L (1/100) | 10 | B1 | B1 |
| 2-23 | 200 mg/ft$^2$ VL-1/gel 4/1; 2 mL/ft$^2$ Esperase 8L (1/100) | 20 | A3 | B3 |
| 2-24 | 200 mg/ft$^2$ VL-1/gel 4/1; 3 mL/ft$^2$ Esperase 8L (1/100) | 30 | A3 | B3 |
| 2-25 | 150 mg/ft$^2$ VL-1/gel 4/1; 1 mL/ft$^2$ Esperase 8L (1/10) | 100 | A3 | B4 |
| 2-28 | 100 mg/ft$^2$ VL-1/gel 4/1; 1 mL/ft$^2$ Esperase 8L (1/10) | 100 | B/D3,4 | B3,4 |

These results show that a protective overcoat can be obtained by enzyme treatment of a coated overcoat layer applied over a functioning photographic imaging element. A coating with the overcoat layer, but without enzyme treatment, is very permeable to aqueous solutions, as indicated by the D4 rating. With enzyme treatment, an effective barrier layer is formed, but the coating can still be processed to form dye. For example, runs 7 and 22 show only moderate sensitivity to staining by Ponceau Red solution, indicating that the gelatin in the imaging layers is protected from the dye by an impermeable layer. Fuithermore, comparison of runs 1–8 and 13 with runs 16–25 and 28 shows that coating on a fully crosslinked substrate is generally beneficial. With the softer (less than fully crosslinked) coating, it is difficult to control the extent of enzymolysis of the structure and a loss of much of the imaging structure occurs. For example, compare runs 2 and 3 with runs 17 and 18. In runs 2 and 3 (on the soft structure), application of an excessive amount of enzyme results in loss of both of the cyan and magenta imaging layers during processing (ranking C5), though the loss becomes somewhat less severe on complete curing of the coating (to C4$^+$). For the fully hardened structure, only the magenta layer is removed (ranking D4) and no change occurs on further standing. Coating a smaller volume of more concentrated enzyme solution, such that the laydown of enzyme is kept essentially constant, is also beneficial (compare runs 1 and 6, 4 and 9, 16 and 21, and 19 and 24). With this enzyme, under these coating conditions, optimal performance is obtained with a laydown of about 30 mg/ft$^2$ of enzyme solution, though some barrier properties are developed by the overcoat with enzyme laydowns in the range between 10 mg/ft$^2$ and 100 mg/ft$^2$. Even very thin overcoat layers are activated by enzyme treatment (runs 10, 13, 25, and 28).

Example 3

This Example illustrate overcoats use in the present invention and the effect of varying the type of enzyme and levels thereof. The samples of this Example were prepared in a manner similar to those of Example 2 using the following coating format:

| Second-pass Layer | |
|---|---|
| water (control) or enzyme solution (invention) | |
| First-pass Layer | |
| 160 mg/ft2 VL-1 | 160 mg/ft2 PU-1 |
| 40 mg/ft2 gelatin | 40 mg/ft2 gelatin |
| 11.4 mg/ft2 BVSM | 11.4 mg/ft2 BVSM |
| Multilayer support S-1 | |

The coatings were allowed to harden for about a week after the application of the overcoat layer (first pass) before the enzyme solutions were applied (second pass). Processing and evaluation of the coatings were performed as described in Example 2; the coatings were allowed to age for about a week after application of the enzyme prior to evaluation. The results are shown in the following table. Without enzyme treatment, no barrier properties were observed with either polymer in the overcoat layer. The results are shown in Tables 6 and 7 below. For the runs in Table 6, the enzyme was applied to the overcoat precusor layer using VL-1/gelatin (160 mg/ft$^2$/40 mg/ft$^2$) (Invention). For the runs in Table 7, the enzyme was applied to the overcoat precusor layer using polyurethane PU-1/gelatin (160 mg/ft$^2$/40 mg/ft$^2$)(Invention).

TABLE 6

| Run | Feature | Lay-down of enzyme solution (mg/ft$^2$) | Rating: Not fused | Rating: Fused (320° F., 1 ips) |
|---|---|---|---|---|
| 3-1 | 1 mL/ft$^2$ Esperase ® 8L (1/10) | 100 | D1 | A1 |
| 3-2 | 1 mL/ft$^2$ Esperase ® 8L (1/30) | 33.3 | D1 | B1 |
| 3-3 | 1 mL/ft$^2$ Esperase ® 8L (1/100) | 10 | D1 | C1 |
| 3-4 | 0.75 mL/ft$^2$ Esperase ® 8L (1/7.5) | 100 | D1 | A1 |
| 3-5 | 0.75 mL/ft$^2$ Esperase ® 8L (1/22.5) | 33.3 | D1 | C$^+$1 |
| 3-6 | 0.75 mL/ft$^2$ Esperase ® 8L (1/75) | 10 | D1 | D1 |
| 3-7 | 0.75 mL/ft$^2$ Savinase ® 6L (1/7.5) | 100 | D1 | B$^+$1 |
| 3-8 | 0.75 mL/ft$^2$ Savinase ® 6L (1/22.5) | 33.3 | D1 | B1 |
| 3-9 | 0.75 mL/ft$^2$ Savinase ® 6L (1/75) | 10 | D1 | D1 |
| 3-10 | 0.75 mL/ft$^2$ Alcalase ® 6L (1/7.5) | 100 | D1 | B1 |
| 3-11 | 0.75 mL/ft$^2$ Alcalase ® 6L(1/22.5) | 33.3 | D1 | B1 |
| 3-12 | 0.75 mL/ft$^2$ Alcalase ® 6L (1/75) | 10 | D1 | D1 |
| 3-13 | 0.75 mL/ft$^2$ Protex ® 6L (1/7.5) | 100 | D1 | A1 |
| 3-14 | 0.75 mL/ft$^2$ Protex ® 6L (1/22.5) | 33.3 | D1 | C$^+$1 |
| 3-15 | 0.75 mL/ft$^2$ Protex ® 6L (1/75) | 10 | D1 | C1 |
| 3-16 | 0.75 mL/ft$^2$ Papain ® (1/100) | 7.5 | D1 | D1 |

TABLE 7

| | | | | |
|---|---|---|---|---|
| 3-17 | 1 mL/ft$^2$ Esperase ® 8L (1/10) | 100 | B1 | A1 |
| 3-18 | 1 mL/ft$^2$ Esperase ® 8L(1/30) | 33.3 | D1 | B1 |
| 3-19 | 1 mL/ft$^2$ Esperase 8L (1/100) | 10 | D1 | C$^+$1 |
| 3-20 | 0.75 mL/ft$^2$ Esperase ® 8L (1/7.5) | 100 | C1 | A1 |
| 3-21 | 0.75 mL/ft$^2$ Esperase ® 8L (1/22.5) | 33.3 | D1 | B1 |
| 3-22 | 0.75 mL/ft$^2$ Esperase ® 8L (1/75) | 10 | D1 | C1 |
| 3-23 | 0.75 mL/ft$^2$ Savinase ® 6L (1/7.5) | 100 | C1 | B$^+$1 |
| 3-24 | 0.75 mL/ft$^2$ Savinase ® 6L (1/22.5) | 33.3 | D1 | B1 |
| 3-25 | 0.75 mL/ft$^2$ Savinase ® 6L (1/75) | 10 | D1 | C1 |
| 3-26 | 0.75 mL/ft$^2$ Alcalase ® 6L (1/7.5) | 100 | D1 | B1 |
| 3-27 | 0.75 mL/ft$^2$ Alcalase 6L (1/22.5) | 33.3 | D1 | B1 |
| 3-28 | 0.75 mL/ft$^2$ Alcalase ® 6L (1/75) | 10 | D1 | B1 |
| 3-29 | 0.75 mL/ft$^2$ Protex ® 6L (1/7.5) | 100 | D1 | B1 |

TABLE 7-continued

| | | | | |
|---|---|---|---|---|
| 3-30 | 0.75 mL/ft$^2$ Protex ® 6L (1/22.5) | 33.3 | D1 | C$^+$1 |
| 3-31 | 0.75 mL/ft$^2$ Protex ® 6L (1/75) | 10 | D1 | C$^+$1 |
| 3-32 | 0.75 mL/ft$^2$ Papain ® (1/100) | 7.5 | D1 | D1 |

With the correct choice of barrier polymer (PU-1 in this case) an overcoat with protective properties may be formed even without fusing if the enzyme solution layer is applied according to the invention (e.g., runs 17, 20 and 23). With fusing, many of the treatments gave good to excellent performance with either polymer. All of the proteases used except for Papain provided an overcoat with at least some protective properties after fusing.

Example 4

The coatings of this Example were prepared in a manner similar to Example 2, except that a spacer layer comprising 100 mg/ft$^2$ of gelatin was coated prior to application of the barrier layer, using the following coating format:

Third-pass Layer: enzyme solution

Second-pass Layer: overcoat barrier layer comprising
160 mg/ft2 polyurethane PU-2
40 mg/ft2 gelatin
11.4 mg/ft2 BVSM
First-pass Layer: spacer layer of 100 mg/ft2 gel
Multilayer Support S-1

The coatings were allowed to cure for about a week prior to the application of the enzyme solutions. For the runs in Table 8 below, 100 mg/ft$^2$ gelatin layer was applied below the overcoat layer (invention). The results arc shown in the Table 8.

| Run | Feature | Laydown of enzyme solution (mg/ft$^2$) | Rating: Not fused | Rating: Fused (320° F., 1 ips) |
|---|---|---|---|---|
| 4-1 | 2 mL/ft$^2$ Esperase 8L (1/10) | 200 | A1 | A1 |
| 4-2 | 2 mL/ft$^2$ Esperase 8L (1/30) | 66.7 | A1 | A1 |
| 4-3 | 2 mL/ft$^2$ Esperase 8L (1/100) | 20 | C1 | A1 |
| 4-4 | 2 mL/ft$^2$ Protex 6L (1/20) | 100 | A1 | A1 |
| 4-5 | 2 mL/ft$^2$ Protex 6L (1/100) | 20 | A1 | A1 |

Without enzyme treatment, the coatings showed no barrier properties either before or after fusing. With a sufficient concentration of enzyme in the final pass, excellent barrier performance is achieved with the polyurethane polymer even without fusing. The presence of a gelatin spacer layer beneath the overcoat layer gives improved performance (for example, compare run 4 of this Example with run 29 of Example 3).

Example 5

The coatings of this Example were prepared in a manner similar to Example 2, using the following coating format:

Enzyme solution

Overcoat: (VL-1 or Polyurethane PU-3 + gelatin 4/1 buffer layer, various levels) + 11.4 mg/ft2 BVSM
Spacer layer:

200 mg/ft2 gelatin buffer layer or
100 mg/ft2 gelatin buffer layer or
50 mg/f2 gelatin buffer layer or
no gelatin buffer layer
Multilayer support S-1

In a first pass, a spacer layer of varying thickness was applied over a multilayer photographic element. A second pass of the barrier layer polymer together with hardener for the entire structure was then applied, and the coatings allowed to cure for about a week at room temperature. A third pass of enzyme solution was then applied. The coatings were processed and evaluated as described for Example 2. The results are shown in Table 9 below.

TABLE 9

| Run | Feature | Laydown of enzyme solution (mg/ft$^2$) | Rating: Not fused | Rating: Fused (320° F., 1 ips) |
|---|---|---|---|---|
| | VL-1; 200 mg/ft2 gelatin buffer layer (invention) | | | |
| 5-1 | 2 mL/ft$^2$ Esperase 8L (1/10) | 200 | B1 | A1 |
| 5-2 | 2 mL/ft$^2$ Protex 6L (1/20) | 100 | A1 | A1 |
| 5-3 | 2 mL/ft$^2$ Esperase 8L (1/100) | 20 | C1 | B1 |
| 5-4 | 3 mL/ft$^2$ Esperase 8L (1/100) | 30 | C1 | B1 |
| 5-5 | 2 mL/ft$^2$ Protex 6L (1/100) | 20 | C1 | A1 |
| 5-6 | 3 mL/ft$^2$ Protex 6L (1/100) | 30 | C1 | A1 |
| | VL-1; 100 mg/f2 gelatin buffer layer (invention) | | | |
| 5-7 | 2 mL/ft$^2$ Esperase 8L (1/10) | 200 | B1 | A1 |
| 5-8 | 2 mL/ft$^2$ Protex 6L (1/20) | 100 | A1 | A1 |
| 5-9 | 2 mL/ft$^2$ Esperase 8L (1/100) | 20 | C1 | B1 |
| 5-10 | 3 mL/ft$^2$ Esperase 8L (1/100) | 30 | C1 | B1 |
| 5-11 | 2 mL/ft$^2$ Protex 6L (1/100) | 20 | C1 | A1 |
| 5-12 | 3 mL/ft$^2$ Protex 6L (1/100) | 30 | C1 | A1 |
| | VL-1; 50 mg/ft2 gelatin buffer layer (invention) | | | |
| 5-13 | 2 mL/ft$^2$ Esperase 8L (1/10) | 200 | B1 | A1 |
| 5-14 | 2 mL/ft$^2$ Protex 6L (1/20) | 100 | C1 | A1 |
| 5-15 | 2 mL/ft$^2$ Esperase 8L (1/100) | 20 | D1 | B1 |
| 5-16 | 3 mL/ft$^2$ Esperase 8L (1/100) | 30 | D1 | B1 |
| 5-17 | 2 mL/ft$^2$ Protex 6L (1/100) | 20 | D1 | A1 |
| 5-18 | 3 mL/ft$^2$ Protex 6L (1/100) | 30 | D1 | A1 |
| | VL-1; no gelatin buffer layer (invention) | | | |
| 5-37 | 2 mL/ft$^2$ Esperase 8L (1/10) | 200 | A1 | A1 |
| 5-38 | 2 mL/ft$^2$ Protex 6L (1/20) | 100 | B$^+$1 | B1 |
| 5-39 | 2 mL/ft$^2$ Esperase 8L (1/100) | 20 | D1 | C1 |
| 5-40 | 3 mL/ft$^2$ Esperase 8L (1/100) | 30 | C1 | C1 |
| 5-41 | 2 mL/ft$^2$ Protex 6L (1/100) | 20 | D1 | C1 |
| 5-42 | 3 mL/ft$^2$ Protex 6L (1/100) | 30 | B1 | C1 |
| | polyurethane PU-3; 200 mg/ft2 gelatin buffer layer (invention) | | | |
| 5-19 | 2 mL/ft$^2$ Esperase 8L (1/10) | 200 | B1 | A1 |
| 5-20 | 2 mL/ft$^2$ Protex 6L (1/20) | 100 | A1 | A1 |
| 5-21 | 2 mL/ft$^2$ Esperase 8L (1/100) | 20 | C1 | B1 |
| 5-22 | 3 mL/ft$^2$ Esperase 8L (1/100) | 30 | C1 | B1 |
| 5-23 | 2 mL/ft$^2$ Protex 6L (1/100) | 20 | B1 | A1 |
| 5-24 | 3 mL/ft$^2$ Protex 6L (1/100) | 30 | B1 | A1 |
| | Polyurethane PU-3; 100 mg/ft2 gelatin buffer layer (invention) | | | |
| 5-25 | 2 mL/ft$^2$ Esperase 8L (1/10) | 200 | C1 | B1 |
| 5-26 | 2 mL/ft$^2$ Protex 6L (1/20) | 100 | C1 | B1 |
| 5-27 | 2 mL/ft$^2$ Esperase 8L (1/100) | 20 | D1 | B1 |
| 5-28 | 3 mL/ft$^2$ Esperase 8L (1/100) | 30 | D1 | B1 |

TABLE 9-continued

| Run | Feature | Laydown of enzyme solution (mg/ft$^2$) | Rating: Not fused | Rating: Fused (320° F., 1 ips) |
|---|---|---|---|---|
| 5-29 | 2 mL/ft$^2$ Protex 6L (1/100) | 20 | D1 | B1 |
| 5-30 | 3 mL/ft$^2$ Protex 6L (1/100) | 30 | D1 | B1 |
| | Polyurethane PU-3; 50 mg/ft2 gelatin buffer layer (invention) | | | |
| 5-31 | 2 mL/ft$^2$ Esperase 8L (1/10) | 200 | C1 | B1 |
| 5-32 | 2 mL/ft$^2$ Protex 6L (1/20) | 100 | D$^+$1 | B1 |
| 5-33 | 2 mL/ft$^2$ Esperase 8L (1/100) | 20 | D1 | B1 |
| 5-34 | 3 mL/ft$^2$ Esperase 8L (1/100) | 30 | D1 | C1 |
| 5-35 | 2 mL/ft$^2$ Protex 6L (1/100) | 20 | D1 | C1 |
| 5-36 | 3 mL/ft$^2$ Protex 6L (1/100) | 30 | D1 | C1 |
| | Polyurethane PU-2; no gelatin buffer layer (invention) | | | |
| 5-43 | 2 mL/ft$^2$ Esperase 8L (1/10) | 200 | C1 | A1 |
| 5-44 | 2 mL/ft$^2$ Protex 6L (1/20) | 100 | D1 | B1 |
| 5-45 | 2 mL/ft$^2$ Esperase 8L (1/100) | 20 | D1 | C1 |
| 5-46 | 3 mL/ft$^2$ Esperase 8L (1/100) | 30 | D1 | C1 |
| 5-47 | 2 mL/ft$^2$ Protex 6L (1/100) | 20 | D1 | C1 |
| 5-48 | 3 mL/ft$^2$ Protex 6L (1/100) | 30 | D1 | C1 |

Without enzyme treatment, none of these coatings showed any resistance to water or to dye uptake in Ponceau Red solution, either with or without fusing (control). To obtain good or excellent barrier performance in this Example, a level of Protex® 6L or Esperase® 8L solutions of around 100 to 200 mg/ft$^2$ was required, though some barrier properties are obtained with only 20 to 30 mg/ft$^2$ of Protex® 6L. The Protex® enzyme solution appears to give better results than Esperase®, sometimes achieving better barrier properties at a lower coated level (compare part 2 with part 1 and part 20 with part 19). Excellent barrier properties are obtained without fusing even for the VL-1 barrier polymer, which under other most circumstances does not form a good barrier without this treatment. With Protex® 6L, the barrier performance improves with a thicker gelatin spacer layer (for example, compare runs 44, 32, 26, and 20 (polyurethane PU-3 barrier polymer, 100 mg/fl$^2$ Protex® 6L) and runs 39, 14, 8 and 2 (VL-1 barrier, 100 mg/ft$^2$ Protex® 6L). In the first series, the barrier performance improves from D1 (no barrier) to A1 (excellent barrier) as the gelatin spacer layer increases in thickness from 0 to 200 mg/ft$^2$. In the second the performance improvement with the same variation is less (from B$^+$1 to A1) but still appreciable.

Example 6

The coatings of this Example were prepared in a manner similar to Example 2, using the following multilayer format:

| |
|---|
| Third pass: Enzyme solution containing various polymers and addenda |
| Second pass: overcoat barrier layer comprising |
| 160 mg/ft2 polyurethane<br>40 mg/ft2 gelatin<br>11.4 mg/ft2 BVSM |
| First pass: spacer layer: |
| 50 mg/ft2 gelatin or<br>100 mg/ft2 gelatin or<br>200 mg/ft2 gelatin or<br>no spacer layer |
| Multilayer Support S-1 |

In a first pass, a spacer layer of varying thickness was applied to the surface of Multilayer Support S-1. A second pass of the barrier layer polymer together with hardener for the entire structure was then applied, and the coatings allowed to cure for about a week at room temperature. A third pass of enzyme solution together with addenda was then applied. The coatings were processed and evaluated as described for Example 2.

The variations coated in this experiment include coating of the enzyme in solutions containing water-soluble polymers (in this Example, Stalok® 140, a modified starch manufactured by Staley Paper Products, Inc., and poly (vinylpyrrolidone)), and also together with materials known to preserve the activity of the enzyme (stabilizers). The melts for the coating were prepared as follows.

Melt 1. A solution of 8.3 g of Protex® 6L and 241.7 g of water was prepared. 3.0 g of a 10% solution of a spreading agent (Olin® 10G, Olin Matheson Co.) was added as a coating aid.

Melt 2 (containing a soluble cationic modified starch): A solution of Stalok 140 was prepared by mixing 25 g of the starch derivative with 475 g of water, allowing the mixture to stand for 30 minutes at room temperature and then heating to 80° C. with stirring. The solution was allowed to cool to room temperature. The melt was then prepared by adding 8.3 g of Protex® 6L to 241.7 g of this solution, mixing, and adding 3.0 g of 10% Olin® 10G as above.

Melt 3 (containing protcase stabilizers together with cationic starch): A solution of 1.2 g triethanolamine, 7.2 g of propylene glycol, and 0.75 g of sodium hydrogen sulfite in 275.8 g of water was prepared. 15 g of Stalok 140 modified starch was added to this solution. The mixture was allowed to stand for 30 minutes at room temperature and then heated to 80° C. with stirring. After cooling to room temperature, 8.3 g of Protex® 6L was mixed with 241.7 g of this solution, and 3.0 g of 10% Olin® 10G added.

Melt 4 (containing protease stabilizers in water): A solution of 4.0 g triethanolamine, 24 g of propylene glycol, and 2.5 g sodium hydrogen sulfite in 969.5 g of water was prepared. The melt was made by mixing 8.3 g of Protex® 6L to 241.7 g of this solution, mixing, and adding 3.0 g of 10% Olin® 10G as above.

Melt 5 (containing polyvinylpyrrolidone): A solution of 5% wt/wt of polyvinylpyrrolidone (MW ca. 40,000) in water was prepared. The melt was then made by mixing 8.3 g of Protex® 6L to 241.7 g of this solution, mixing, and adding 3.0 g of 10% Olin® 10G as above.

TABLE 10

| Run | Feature | Laydown of enzyme solution (mg/ft$^2$) | Rating: Not fused | Rating: Fused (320 F., 1 ips) |
|---|---|---|---|---|
| | 50 mg/ft2 gelatin layer applied below PU overcoat | | | |
| 6-1 | 2 mL/ft$^2$ Protex ® 6L (1/30) in water (Melt 1) | 66.7 | B1 | A1 |
| 6-2 | 2 mL/ft$^2$ Protex ® 6L (1/30) in water with 5% Stalok ® 140 (modified starch) (Melt 2) | 66.7 | A1 | A1 |
| 6-3 | 2 mL/ft$^2$ Protex ® 6L (1/30) in water with 5% Stalok ® 140 (modified starch) + stabilizers (Melt 3) | 66.7 | A3 | B3 |
| 6-4 | 2 mL/ft$^2$ Protex ® 6L (1/30) in water with stabilizers (Melt 4) | 66.7 | A3 | B3 |

TABLE 10-continued

| Run | Feature | Laydown of enzyme solution (mg/ft$^2$) | Rating Not fused | Rating Fused (320 F., 1 ips) |
|---|---|---|---|---|
| 6-5 | 2 mL/ft$^2$ Protex ® 6L (1/30) in water with 5% polyvinyl-pyrrolidone (Melt 5) | 66.7 | B1 | A1 |
| | 100 mg/ft$^2$ gelatin layer applied below PU overcoat | | | |
| 6-6 | 2 mL/ft$^2$ Protex ® 6L (1/30) in water (Melt 1) | 66.7 | B1 | A1 |
| 6-7 | 2 mL/ft$^2$ Protex ® 6L (1/30) in water with 5% Stalok ® 140 (modified starch) (Melt 2) | 66.7 | A1 | A1 |
| 6-8 | 2 mL/ft$^2$ Protex ® 6L (1/30) in water with 5% Stalok ® 140 (modified starch) + stabilizers (Melt 3) | 66.7 | A1 | A1 |
| 6-9 | 2 mL/ft$^2$ Protex ® 6L (1/30) in water with stabilizers (Melt 4) | 66.7 | B3 | B3 |
| 6-10 | 2 mL/ft$^2$ Protex ® 6L (1/30) in water with 5% polyvinyl-pyrrolidone (Melt 5) | 66.7 | B1 | A1 |
| | 200 mg/ft$^2$ gelatin layer applied below PU overcoat | | | |
| 6-11 | 2 mL/ft$^2$ Protex ® 6L (1/30) in water (Melt 1) | 66.7 | B1 | A1 |
| 6-12 | 2 mL/ft$^2$ Protex ® 6L (1/30) in water with 5% Stalok ® 140 (modified starch) (Melt 2) | 66.7 | A1 | A1 |
| 6-13 | 2 mL/ft$^2$ Protex ® 6L (1/30) in water with 5% Stalok ® 140 (modified starch) + stabilizers (Melt 3) | 66.7 | B$^+$1 | A1 |
| 6-14 | 2 mL/ft$^2$ Protex ® 6L (1/30) in water with stabilizers (Melt 4) | 66.7 | B3 | B3 |
| 6-15 | 2 mL/ft$^2$ Protex ® 6L (1/30) in water with 5% polyvinyl-pyrrolidone (Melt 5) | 66.7 | B1 | A1 |
| | PU overcoat only; no buffer layer | | | |
| 6-16 | 2 mL/ft$^2$ Protex ® 6L (1/30) in water (Melt 1) | 66.7 | A1 | A1 |
| 6-17 | 2 mL/ft$^2$ Protex ® 6L (1/30) in water with 5% Stalok ® 140 (modified starch) (Melt 2) | 66.7 | A1 | A1 |
| 6-18 | 2 mL/ft$^2$ Protex ® 6L (1/30) in water with 5% Stalok ® 140 (modified starch) + stabilizers (Melt 3) | 66.7 | B$^+$1 | B1 |
| 6-19 | 2 mL/ft$^2$ Protex ® 6L (1/30) in water with stabilizers (Melt 4) | 66.7 | B2,4 | B2,4 |
| 6-20 | 2 mL/ft$^2$ Protex ® 6L (1/30) in water with 5% polyvinyl-pyrrolidone (Melt 5) | 66.7 | A1 | A1 |

The use of water-soluble polymers together with the enzyme solution does not interfere with the enzyme activity, nor with the formation of a barrier layer during processing. In fact, the use of such polymers can improve the performance of the barrier, as indicated by a comparison of run 2 with run 1, run 7 with run 6, and run 12 with run 11. The use of stabilizers in the coating melt increases the enzyme activity, so that some removal of the overcoat is observed at the chosen level of enzyme (compare run 19 with run 16, run 14 with run 11, and run 3 with run 2).

Example 7

This Example demonstrates that a protective barrier layer can be prepared on a freshly prepared multilayer photographic element by in-line sequential coating of the enzyme solution.

Sample 5 (the check for Sample 6 to 10) was prepared by coating in sequence a blue-light sensitive layer, an interlayer, a green-light sensitive layer, a UV layer, a red-light sensitive layer, a UV layer and an overcoat on photographic paper support. The components in each individual layer are described below.

Blue Sensitive Emulsion (Blue EM-1).

A high chloride silver halide emulsion is precipitated by adding approximately equimolar silver nitrate and sodium chloride solutions into a well stirred reactor containing glutaryldiaminophenyldisulfide, gelatin peptizer and thioether ripener. Cesium pentachloronitrosylosmate(II) dopant is added during the silver halide grain formation for most of the precipitation, followed by the addition of potassium hexacyanoruthenate(II), potassium (5-methylthiazole)-pentachloroiridate, a small amount of KI solution, and shelling without any dopant. The resultant emulsion contains cubic shaped grains having edge length of 0.6 $\mu$m. The emulsion is optimally sensitized by the addition of a colloidal suspension of aurous sulfide and heat ramped to 60° C. during which time blue sensitizing dye BSD-4, potassium hexchloroiridate, Lippmann bromide and 1-(3-acetamidophenyl)-5-mercaptotetrazole were added.

Green Sensitive Emulsion (Green EM-1):

A high chloride silver halide emulsion is precipitated by adding approximately equimolar silver nitrate and sodium chloride solutions into a well stirred reactor containing, gelatin peptizer and thioether ripener. Cesium pentachloronitrosylosmate(II) dopant is added during the silver halide grain formation for most of the precipitation, followed by the addition of potassium (5-methylthiazole)-pentachloroiridate. The resultant emulsion contains cubic shaped grains of 0.31 $\mu$m in edgelength size. The emulsion is optimally sensitized by the addition of glutaryldiaminophenyldisulfide, a colloidal suspension of aurous sulfide and heat ramped to 55° C. during which time potassium hexachloroiridate doped Lippmann bromide, a liquid crystalline suspension of green sensitizing dye GSD-1, and 1-(3-acetamidophenyl)-5-mercaptotetrazole were added.

Red Sensitive Emulsion (Red EM-1):

A high chloride silver halide emulsion is precipitated by adding approximately equimolar silver nitrate and sodium chloride solutions into a well stirred reactor containing gelatin peptizer and thioether ripener. During the silver halide grain formation, potassium hexacyanoruthenate(II) and potassium (5-methylthiazole)-pentachloroiridate are added. The resultant emulsion contains cubic shaped grains of 0.4 $\mu$m in edge length size. The emulsion is optimally sensitized by the addition of glutaryldiaminophenyldisulfide, sodium thiosulfate, tripotassium bis{2-[3-(2-sulfobenzamido)phenyl]-mercaptotetrazole} gold(I) and heat ramped to 64° C. during which time 1-(3-acetamidophenyl)-5-mercaptotetrazole, potassium hexachloroiridate, and potassium bromide are added. The emulsion is then cooled to 40° C., pH adjusted to 6.0 and red sensitizing dye RSD-1 is added.

Coupler dispersions were emulsified by methods well known in the art. The following imaging layers were coated in sequence on polyethylene-laminated photographic paper.

| Layer | Item | Laydown (mg/ft$^2$) |
|---|---|---|
| Layer 1 | Blue Sensitive Layer | |
| | Gelatin | 122.0 |

-continued

| Layer | Item | Laydown (mg/ft$^2$) |
|---|---|---|
| | Blue sensitive silver (Blue EM-1) | 22.29 |
| | Y-4 | 38.49 |
| | ST-23 | 44.98 |
| | Tributyl Citrate | 20.24 |
| | ST-24 | 11.25 |
| | ST-16 | 0.883 |
| | Sodium Phenylmercaptotetrazole | 0.009 |
| | Piperidino hexose reductone | 0.2229 |
| | 5-chloro-2-methyl-4-isothiazolin-3-one/2-methyl-4-isothiazolin-3-one(3/1) | 0.019 |
| | SF-1 | 3.40 |
| | Potassium chloride | 1.895 |
| | Dye-1 | 1.375 |
| Layer 2 | Interlayer | |
| | Gelatin | 69.97 |
| | ST-4 | 9.996 |
| | Diundecyl phthalate | 18.29 |
| | 5-chloro-2-methyl-4-isothiazolin-3-one/2-methyl-4-isothiazolin-3-one(3/1) | 0.009 |
| | Catechol disulfonate | 3.001 |
| | SF-1 | 0.753 |
| Layer 3 | Green Sensitive Layer | |
| | Gelatin | 110.96 |
| | Green sensitive silver (Green EM-1) | 9.392 |
| | M-4 | 19.29 |
| | Oleyl Alcohol | 20.20 |
| | Diundecyl phthalate | 10.40 |
| | ST-1 | 3.698 |
| | ST-3 | 26.39 |
| | Dye-2 | 0.678 |
| | 5-chloro-2-methyl-4-isothiazolin-3-one/2-methyl-4-isothiazolin-3-one(3/1) | 0.009 |
| | SF-1 | 2.192 |
| | Potassium chloride | 1.895 |
| | Sodium Phenylmercaptotetrazole | 0.065 |
| Layer 4 | M/C Interlayer | |
| | Gelatin | 69.97 |
| | ST-4 | 9.996 |

-continued

| Layer | Item | Laydown (mg/ft$^2$) |
|---|---|---|
| | Diundecyl phthalate | 18.29 |
| | Acrylamide/t-Butylacrylamide sulfonate copolymer | 5.026 |
| | Bis-vinylsulfonylmethane | 12.91 |
| | 3,5-Dinitrobenzoic acid | 0.009 |
| | Citric acid | 0.065 |
| | Catechol disulfonate | 3.001 |
| | 5-chloro-2-methyl-4-isothiazolin-3-one/2-methyl-4-isothiazolin-3-one(3/1) | 0.009 |
| Layer 5 | Red Sensitive Layer | |
| | Gelatin | 125.96 |
| | Red Sensitive silver (Red EM-1) | 17.49 |
| | IC-35 | 21.59 |
| | IC-36 | 2.397 |
| | UV-1 | 32.99 |
| | Dibutyl sebacate | 40.49 |
| | Tris(2-ethylhexyl)phosphate | 13.50 |
| | Dye-3 | 2.127 |
| | Potassium p-toluenethiosulfonate | 0.242 |
| | 5-chloro-2-methyl-4-isothiazolin-3-one/2-methyl-4-isothiazolin-3-one(3/1) | 0.009 |
| | Sodium Phenylmercaptotetrazole | 0.046 |
| | SF-1 | 4.868 |
| Layer 6 | UV Overcoat | |
| | Gelatin | 76.47 |
| | UV-2 | 3.298 |
| | UV-1 | 18.896 |
| | ST-4 | 6.085 |
| | SF-1 | 1.162 |
| | Tris(2-ethylhexyl)phosphate | 7.404 |
| | 5-chloro-2-methyl-4-isothiazolin-3-one/2-methyl-4-isothiazolin-3-one(3/1) | 0.009 |
| Layer 7 | SOC | |
| | Gelatin | 60.0 |
| | SF-1 | 1.0 |
| | SF-2 | 0.39 |
| | Bis(vinylsulfonyl)methane | 9.14 |

BSD-4

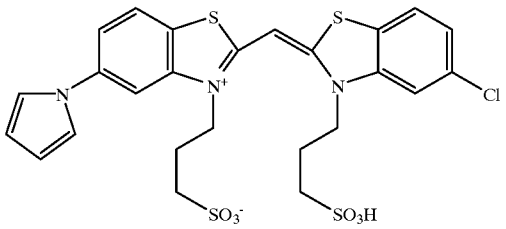

GSD-1

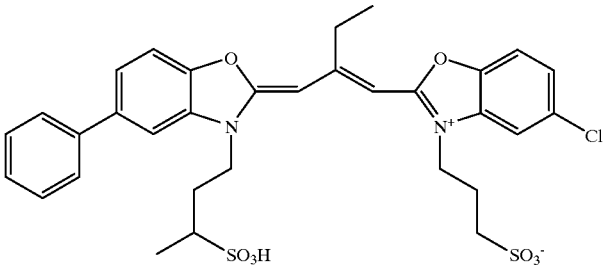

-continued
RSD-1
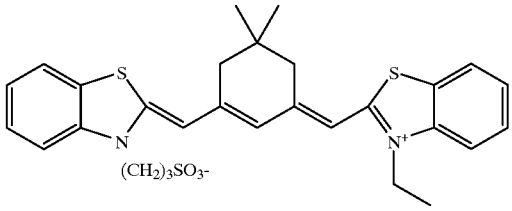
Y-4
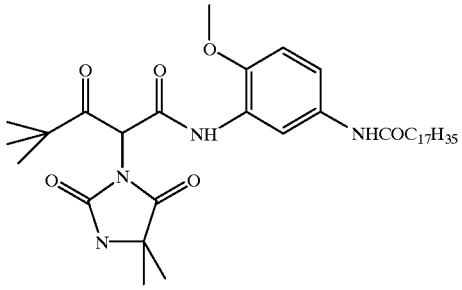
M-4
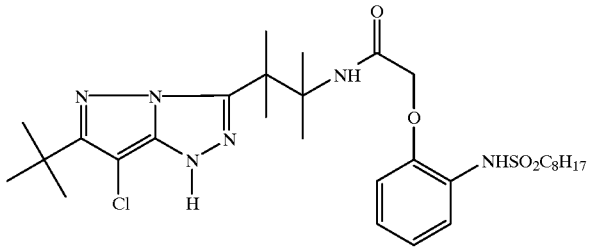
IC-35
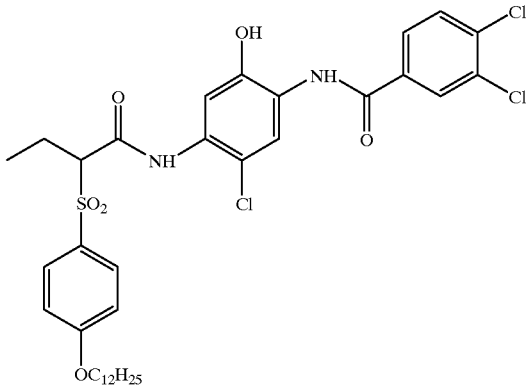
IC-36
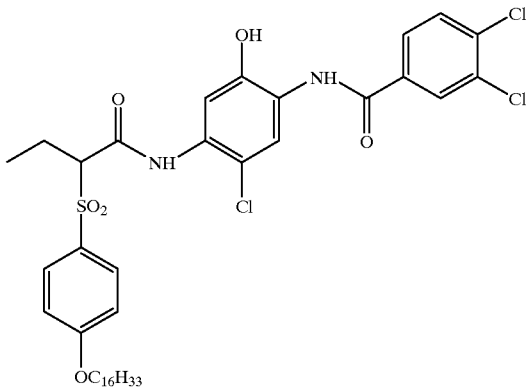

-continued
Dye-1
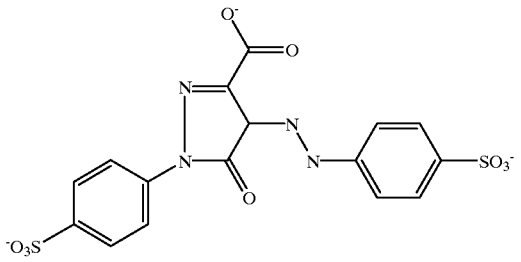
Dye-2
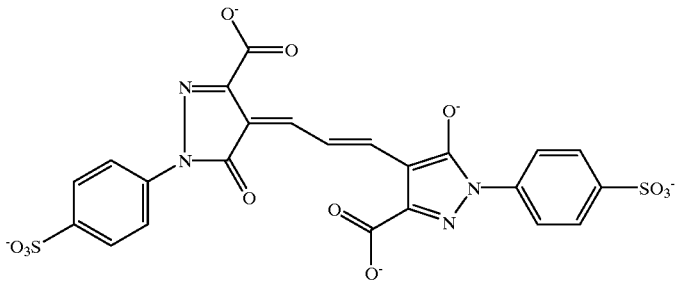
Dye-3
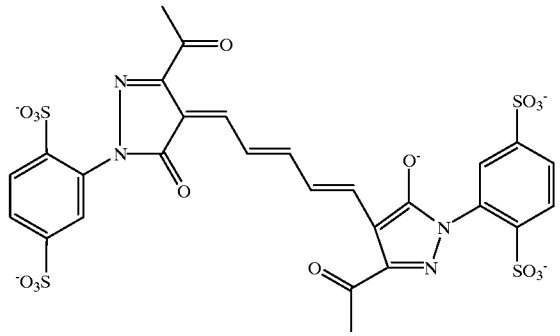
ST-1
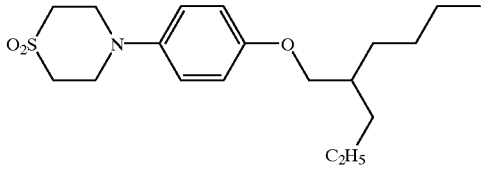
ST-3
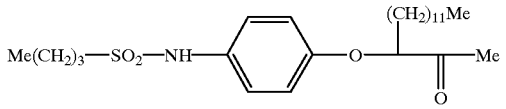
ST-4
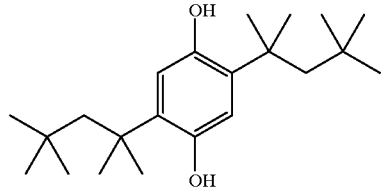

-continued
ST-16
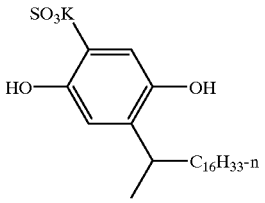
ST-23
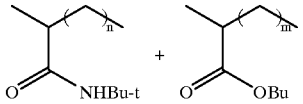
n:m = 1:1; MW = 75,000–100,000
n:m = 1:1; MW = 75,000–100,000
ST-24
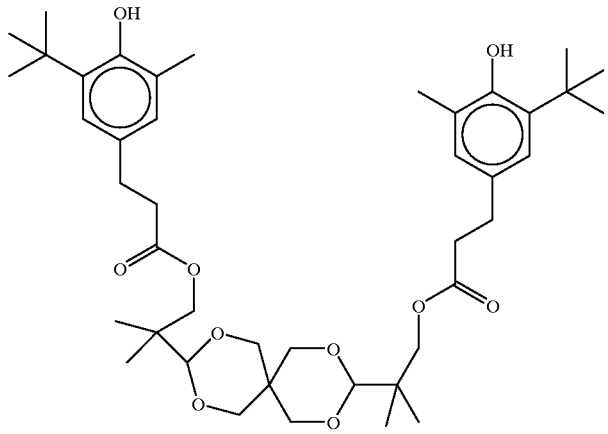
UV-1
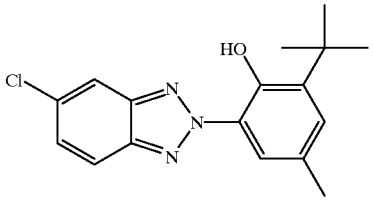
UV-2
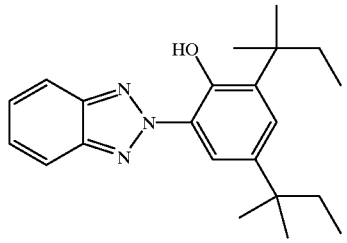
SF-1
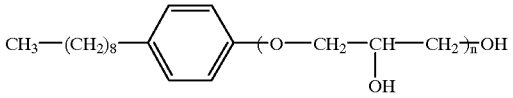
SF-2 $CF_3.(CF_2)_7.SO_3Na$ Using a multilayer coating machine equipped with a slide hopper with 7 delivery slots, the following layers in Table 11 were applied to a resin-coated paper support.

TABLE 11

| Slot | Melt | PA (lb/100 ft$^2$) | Flow rate (g/min) | Flow rate (g/min) | Lay-down (mg/ft$^2$) |
|---|---|---|---|---|---|
| 1 | Yellow Emulsion | 0.099 | 15.0 | | — |
| 1 | Yellow Dispersion | 0.206 | 31.2 | 46.2 | |
| 1 | crosslinker in water | 0.212 | 30.6 | 30.6 | — |
| 2 | Y/M interlayer | 0.096 | 14.5 | 29.1 | |
| 3 | Magenta Emulsion | 0.076 | 11.5 | | — |
| 3 | Magenta Dispersion | 0.126 | 19.1 | 30.6 | |
| 4 | M/C interlayer | 0.096 | 14.5 | | |
| 5 | Cyan Emulsion | 0.087 | 13.2 | | — |
| 5 | Cyan Dispersion | 0.162 | 24.5 | 37.7 | |
| 6 | 16% gelatin solution | 0.103 | 15.6 | 15.6 | 75 |
| 6 | | 0.241 | 36.5 | 36.5 | 175 |
| 6 | | 0.379 | 57.4 | 57.4 | 275 |
| 6 | UV layer | 0.106 | 16.0 | 16.0 | 75 (gelatin only) |
| 7 | 14% VL-1/gelatin 4/1 | 0.252 | 38.1 | 38.1 | 200 (total) |
| 7 | 9% Polyurethane/ gelatin 4/1 | 0.392 (total) | 59.3 | 59.3 | 200 |

EPOCH® melts were used; the structure was coated at 100 fpm. Either gelatin (at indicated levels) or the UV layer was coated, not both; likewise either the VL-1 overcoat or the polyurethane (PU-4) overcoat was coated, not both. Enzyme solutions were applied in-line at various levels at a second coating station equipped with single slot extrusion hopper according to the following Table 12.

TABLE 12

| Run | Feature | Laydown of enzyme solution (mg/ft$^2$) | Rating: Not fused | Rating: Fused (320° F., 1 ips) |
|---|---|---|---|---|
| | Polyurethane (PU-4)/gelatin overcoat | | | |
| 7-1 | 75 mg/ft$^2$ gelatin buffer layer X-hopper: water (check) | 0 | D1 | D1 |
| 7-2 | 175 mg/ft$^2$ gelatin buffer layer X-hopper: water (check) | 0 | D1 | D1 |
| 7-3 | 275 mg/ft$^2$ gelatin buffer layer X-hopper: water (check) | 0 | D1 | D1 |
| 7-4 | 75 mg/ft$^2$ gelatin buffer layer X-hopper: Protex ® 6L (1/100) (invention) | 33 | C1 | B1 |
| 7-5 | 175 mg/ft$^2$ gelatin buffer layer X-hopper: Protex ® 6L (1/100) (invention) | 33 | C1 | B1 |
| 7-6 | 275 mg/ft$^2$ gelatin buffer layer X-hopper: Protex ® 6L (1/100) (invention) | 33 | A1 | A1 |
| 7-7 | 75 mg/ft$^2$ gelatin buffer layer X-hopper: Protex ® 6L (1/10) (invention) | 330 | A1 | A1 |
| 7-8 | 175 mg/ft$^2$ gelatin buffer layer X-hopper: Protex ® 6L (1/10) (invention) | 330 | B$^{+1}$ | B$^{+1}$ |
| 7-9 | 275 mg/ft$^2$ gelatin buffer layer X-hopper: Protex ® 6L (1/10) (invention) | 330 | B1 | A1 |
| | VL-1 overcoat | | | |
| 7-10 | 75 mg/ft$^2$ gelatin buffer layer X-hopper: Protex ® 6L (1/100) (invention) | 33 | C3 | B3 |
| 7-11 | 175 mg/ft$^2$ gelatin buffer layer X-hopper: Protex ® 6L (1/100) (invention) | 33 | D$^{+2}$ | D2 |
| 7-12 | 275 mg/ft$^2$ gelatin buffer layer X-hopper: Protex ® 6L (1/100) (invention) | 33 | C2 | B2 |
| 7-13 | 75 mg/ft$^2$ gelatin buffer layer X-hopper: Protex ® 6L (1/10) (invention) | 330 | D4 | D4 |
| 7-14 | 175 mg/ft$^2$ gelatin buffer layer X-hopper: Protex ® 6L (1/10) (invention) | 330 | D3 | D3 |
| 7-15 | 275 mg/ft$^2$ gelatin buffer layer X-hopper: Protex ® 6L (1/10) (invention) | 330 | C3 | C3 |
| 7-16 | 75 mg/ft$^2$ gelatin buffer layer X-hopper: Protex ® 6L (1/30) (invention) | 100 | D4 | D4 |
| 7-17 | 175 mg/ft$^2$ gelatin buffer layer X-hopper: Protex ® 6L (1/30) (invention) | 100 | D3 | D3 |
| 7-18 | 275 mg/ft$^2$ gelatin buffer layer X-hopper: Protex ® 6L (1/30) (invention) | 100 | B2 | C2 |
| 7-19 | 75 mg/ft$^2$ gelatin buffer layer X-hopper: water (check) | 0 | D1 | D1 |
| 7-20 | 175 mg/ft$^2$ gelatin buffer layer X-hopper: water (check) | 0 | D1 | D1 |
| 7-21 | 275 mg/ft$^2$ gelatin buffer layer X-hopper: water (check) | 0 | D1 | D1 |
| 7-22 | UV layer X-hopper: Protex ® 6L (1/100) (invention) | 33 | D3 | D3 |
| 7-23 | UV layer X-hopper: Protex ® 6L (1/30) (invention) | 100 | −6* | −6* |

*Entire coating removed to support on processing.

It is possible to coat the enzyme solution in an immediately applied second pass as an aqueous wash over a freshly coated slide-hopper multilayer pack and obtain good barrier properties. The best results were obtained when the overcoat and enzyme layers were applied over a gelatin spacer layer, and the performance of the overcoat improves as the laydown of the buffer layer increases (compare runs 4, 5, and 6 and 16, 17, and 18). In this Example, if the gelatin spacer layer is not included, the enzyme degrades the entire structure (runs 22 and 23), which then dissolves during processing. The polyurethane overcoat gives excellent performance with an enzyme at a level of 33 and 330 mg/ft$^2$ of Protex® 6L enzyme when the coating includes a spacer layer of between 175 and 275 mg/ft$^2$.

What is claimed is:

1. A photographic imaging element comprising:

a support;

at least one light sensitive silver-halide emulsion imaging layer superposed on the support; and an overcoat layer overlying the at least one light sensitive silver halide emulsion imaging layer, which overcoat comprises a hydrophobic polymer mixed with gelatin, wherein the imaging element further comprises an enzyme capable of digesting the gelatin in the overcoat layer, which enzyme is in reactive association with overcoat layer for digesting the gelatin in the overcoat layer.

2. The photographic imaging element of claim 1 further comprising at least one stabilizer or cofactor that modifies the activity of the enzyme.

3. The photographic imaging element of claim 1 further comprising at least one inhibitor that modifies the activity of the enzyme.

4. The photographic imaging element of claim 1 in which a stabilizer, cofactor, and/or inhibitor that modifies the activity of the enzyme is contained in either the imaging layer or the overcoat layer or a separate layer containing the enzyme.

5. The photographic imaging element of claim 1 in which the enzyme is a serine protease.

6. The photographic imaging element of claim 1 in which the enzyme is contained in a layer separate from the overcoat layer in combination with a hydrophilic polymer.

7. The photographic imaging element of claim 1 in which the overcoat layer is coated over a barrier layer to block the enzyme from reaching the imaging layer, which barrier layer comprises a vehicle, but essentially no dispersions, emulsions, or other particulate materials.

8. The photographic imaging element of claim 1 in which the an enzyme-containing layer contains a hydrophilic polymer that is not capable of being digested by the enzyme.

9. The photographic imaging element of claim 1 in which the imaging layer is coated on a support comprising a cellulosic layer.

10. The photographic imaging element of claim 1 wherein both the overcoat and the imaging layer contains a hardener for the gelatin contained therein.

11. The photographic imaging element of claim 1 wherein only the imaging layer but not the protective layer contains a hardener.

12. A method of making a photographic print comprising:

(a) providing a photographic element comprising a support, at least one silver-halide emulsion imaging layer superposed on a side of said support, a processing-solution-permeable overcoat layer overlying the silver-halide emulsion imaging layer, said overcoat comprising a hydrophobic polymer mixed with gelatin, wherein the photographic element further comprises an enzyme capable of digesting gelatin in the overcoat layer, which enzyme is in the overcoat layer and/or in a separate layer from which the enzyme can diffuse into the overcoat layer to digest the gelatin;

(b) imagewise exposing to light and developing the photographic element in a developer solution having a pH greater than 7 to obtain the photographic print; and (c) optionally fusing the processing-solution-permeable;

wherein the overcoat forms a water-resistant protective overcoat in the processed photographic element.

13. The method of claim 12 comprising treatment with heat, or with pressure and heat, to form a protective water-repellent layer.

14. The method of claim 12 comprising treatment with radiant heat to form a protective water-repellent layer.

15. The method of claim 12 wherein the fusing step further comprises texturing a surface of the processing solution permeable overcoat.

16. A process of manufacturing a photographic element comprising (a) applying to a support at least one light sensitive silver-halide emulsion imaging layer; and (b) applying an overcoat layer over the at least one light sensitive silver halide emulsion imaging layer, which overcoat layer comprises a hydrophobic polymer mixed with gelatin, wherein an enzyme capable of digesting the gelatin is contained in the photographic element in reactive association with the overcoat layer, either in the overcoat layer and/or in a separate layer also applied over the light sensitive silver-halide emulsion imaging layer.

17. The method of claim 16 wherein the separate layer containing the enzyme is applied, in combination with a hydrophilic polymer, over the overcoat.

18. The method of claim 16 wherein the overcoat is applied over a hardened image layer and does not itself contain a hardener when applied.

19. The method of claim 16 wherein the overcoat layer is applied over an image layer that does not contain a hardener.

20. The method of claim 19 wherein a hardener is applied in the overcoat, a separate enzyme-containing layer, and/or in a non-image gelatin layer.

21. The method of claim 16 wherein all the coatings are applied simultaneously.

22. The method of claim 21 wherein a hardener is contained in any one or combination of layers of the photographic element.

23. The method of claim 21 in which the coatings are simultaneously applied at a single coating station by a slide hopper.

24. The method of claim 16 in which the enzyme is applied separately from the imaging layer.

25. The method of claim 24 in which the enzyme is applied in-line at a separate coating station after the at least one imaging layer is applied and allowed to dry.

26. The method of claim 24 in which the enzyme is applied separately from the imaging layer after the imaging layer has been allowed to dry and harden.

27. The method of claim 26 in which the gelatin in the overcoat layer is not hardened or is relatively unhardened compared to the gelatin in the imaging layer.

28. The method of claim 16 in which enzyme is applied in a solution comprising a hydrophilic polymer or rheology modifier that is not digested, degraded or modified by the enzyme, which is coated as part of a multilayer slide hopper coating pass.

* * * * *